US011848529B2

(12) United States Patent
Tachi et al.

(10) Patent No.: US 11,848,529 B2
(45) Date of Patent: Dec. 19, 2023

(54) JOINT PORTION CONNECTING A TERMINAL BLOCK CONNECTION TERMINAL WITH A COUNTERPART TERMINAL

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Kentaro Tachi, Yokkaichi (JP); Dohyung Kim, Yokkaichi (JP); Mitsuru Hirose, Yokkaichi (JP); Daisuke Hashimoto, Yokkaichi (JP); Soichiro Okumura, Osaka (JP)

(73) Assignees: AUTONETWORKS TECHNOLOGIES, LTD., Mie-ken (JP); SUMITOMO WIRING SYSTEMS, LTD., Mie-ken (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/637,792

(22) PCT Filed: Jun. 17, 2020

(86) PCT No.: PCT/JP2020/023662
§ 371 (c)(1),
(2) Date: Feb. 23, 2022

(87) PCT Pub. No.: WO2021/039041
PCT Pub. Date: Mar. 4, 2021

(65) Prior Publication Data

US 2022/0320762 A1 Oct. 6, 2022

(30) Foreign Application Priority Data

Aug. 26, 2019 (JP) ..... 2019-153652

(51) Int. Cl.
*H01R 9/24* (2006.01)

(52) U.S. Cl.
CPC ..... *H01R 9/24* (2013.01)

(58) Field of Classification Search
CPC ..... H01R 9/114; H01R 9/24–13/113; H01H 50/048; B60L 53/16
See application file for complete search history.

(56) References Cited

U.S. PATENT DOCUMENTS 5,603,626 A 2/1997 Oka et al.
6,872,096 B2 * 3/2005 Baker ..... H01R 11/09 439/654

(Continued)

FOREIGN PATENT DOCUMENTS

JP S58-041668 Y2 9/1983
JP H11-297380 A 10/1999

(Continued)

*Primary Examiner* — Vanessa Girardi

(57) ABSTRACT

The present disclosure provides a terminal block that can be kept compact. A terminal block has a housing made of a synthetic resin, a columnar metal connection terminal held by the housing, and a cylindrical metal joint part in which a device connection part of the connection terminal is inserted. The joint part has a cylindrical part in which the device connection part is inserted and a cylindrical part in which an end part of a device-side terminal electrically connected to the connection terminal is inserted. The connection terminal is electrically connected to the device-side terminal via the joint part.

13 Claims, 9 Drawing Sheets

(56) References Cited

U.S. PATENT DOCUMENTS

| | | | | |
|---|---|---|---|---|
| 10,270,187 | B2 * | 4/2019 | Morita | H01R 4/34 |
| 10,992,069 | B2 | 4/2021 | Kudo | |

FOREIGN PATENT DOCUMENTS

| | | | |
|---|---|---|---|
| JP | 2001-110534 | A | 4/2001 |
| JP | 2005-209517 | A | 8/2005 |
| JP | 2009-140705 | A | 6/2009 |
| JP | 2018-190807 | A | 11/2018 |

* cited by examiner

JOINT PORTION CONNECTING A TERMINAL BLOCK CONNECTION TERMINAL WITH A COUNTERPART TERMINAL

BACKGROUND

Field of the Disclosure

The present disclosure relates to a terminal block.

Related Art

Conventionally, as a device connector coupled to an electric device, a terminal block is known that includes planar connection terminals for relaying the electrical connection between device terminals in the electric device and wire terminals connected to ends of wires (for example, Japanese Laid-Open Patent Publication No. 2019-16448).

This type of terminal block has multiple connection terminals and a housing that holds these connection terminals. One end portion of each connection terminal is electrically connected to a device terminal by bolting, and the other end portion of the connection terminal is electrically connected to a wire terminal by bolting.

However, the above terminal block requires clearances for inserting a bolting tool (also referred to as a space for bolting work) between adjacent connection terminals, resulting in the problem of an increased size of the terminal block.

It is an objective of the present disclosure to provide a terminal block that limits an increase in size.

SUMMARY

A terminal block according to the present disclosure includes a housing made of a synthetic resin, a metal connection terminal that is columnar and held by the housing, and a metal joint portion that is tubular and in which an end portion of the connection terminal is inserted.

The terminal block according to the present disclosure advantageously limits an increase in size.

DETAILED DESCRIPTION

Description of Embodiments of Present Disclosure

Figure 1:
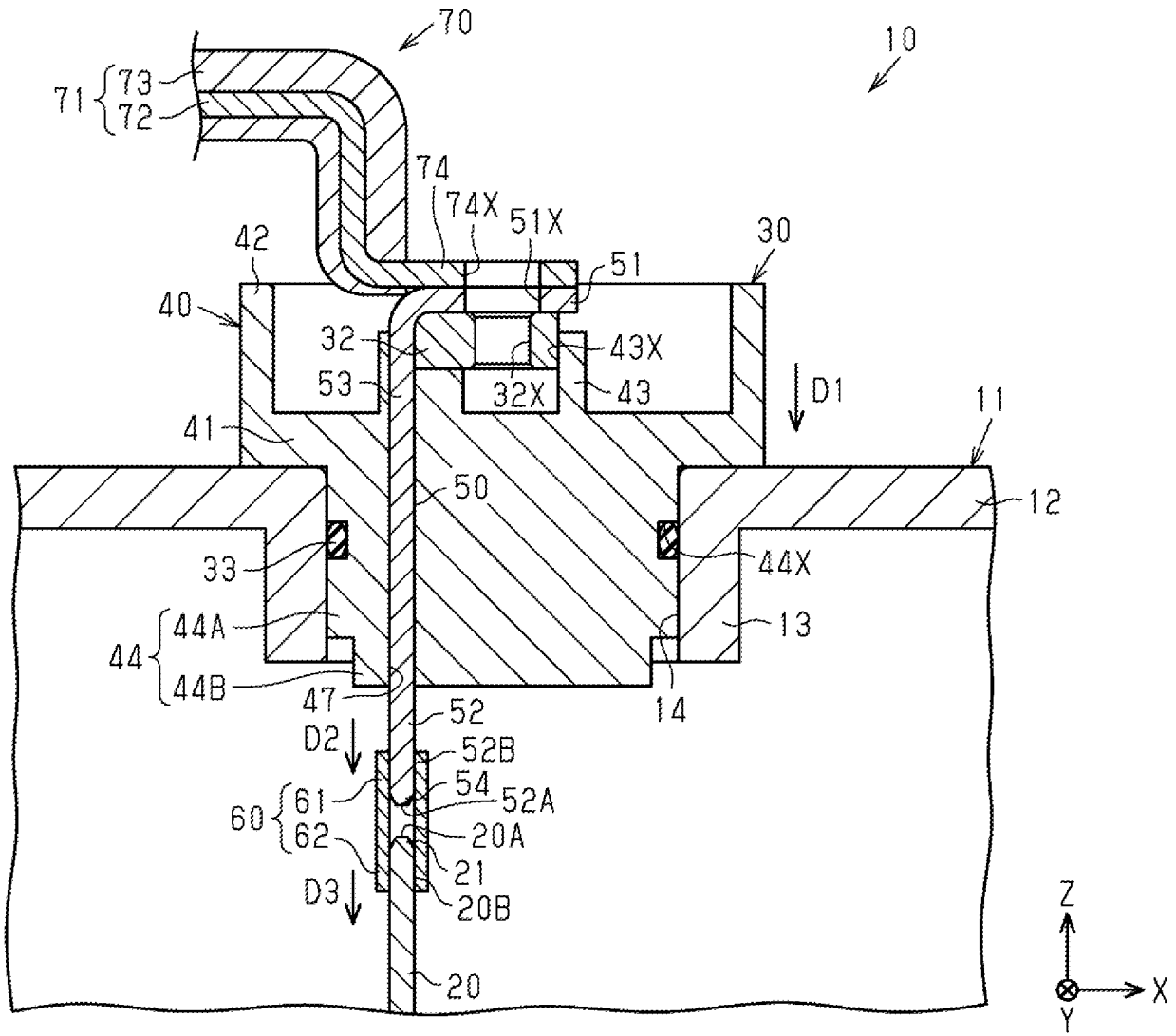
FIG. 1 is a schematic cross-sectional view showing a connection device of a first embodiment.

First, embodiments of the present disclosure are listed and explained.

[1] A terminal block according to the present disclosure includes a housing made of a synthetic resin, a metal connection terminal that is columnar and held by the housing, and a metal joint portion that is tubular and in which an end portion of the connection terminal is inserted.

According to this configuration, by inserting a counterpart terminal, to which the connection terminal is to be connected, into the joint portion, the connection terminal is electrically connected to the counterpart terminal via the joint portion. The electrical connection between the connection terminal and the counterpart terminal is thus achieved without using a connection tool such as a bolting tool. The space for a connection tool is therefore omitted, allowing adjacent connection terminals to be arranged at smaller intervals. This limits an increase in size of the terminal block.

[2] The joint portion preferably includes a first tubular section in which the end portion of the connection terminal is inserted and a second tubular section in which an end portion of a counterpart terminal to be electrically connected to the connection terminal is to be inserted. The connection terminal is preferably configured to be electrically connected to the counterpart terminal via the joint portion.

According to this configuration, by inserting the connection terminal into the first tubular section and inserting the counterpart terminal into the second tubular section, the connection terminal is electrically connected to the counterpart terminal via the joint portion.

[3] The first tubular section preferably has an inner perimeter shape that is mathematically similar to an outer perimeter shape of the end portion of the connection terminal. The second tubular section preferably has an inner perimeter shape that is mathematically similar to an outer perimeter shape of the end portion of the counterpart terminal.

According to this configuration, the mathematically similar shapes of the inner perimeter of the first tubular section and the outer perimeter of the connection terminal allow the outer surface of the connection terminal to be in contact with the inner surface of the first tubular section in a suitable manner when the end portion of the connection terminal is inserted in the first tubular section. This increases the area of contact between the outer surface of the connection terminal and the inner surface of the first tubular section. Furthermore, the mathematically similar shapes of the inner perimeter of the second tubular section and the outer perimeter of the end portion of the counterpart terminal allow the outer surface of the counterpart terminal to be in contact with the inner surface of the second tubular section in a suitable manner when the end portion of the counterpart terminal is inserted in the second tubular section. This increases the area of contact between the outer surface of the counterpart terminal and the inner surface of the second tubular section.

[4] The connection terminal preferably has a shape of a polygonal column or a circular column. The counterpart terminal preferably has a shape of a polygonal column or a circular column. The first tubular section preferably has a shape of a polygonal tube or a circular tube. The second tubular section preferably has a shape of a polygonal tube or a circular tube.

According to this configuration, when the connection terminal has the shape of a polygonal column, the first tubular section has the shape of a polygonal tube. When the connection terminal has the shape of a circular column, the first tubular section has the shape of a circular tube. When the counterpart terminal has the shape of a polygonal column, the second tubular section has the shape of a polygonal tube. When the counterpart terminal has the shape of a circular column, the second tubular section has the shape of a circular tube. Accordingly, when the end portion of the connection terminal is inserted in the first tubular section, the outer surface of the connection terminal is in contact with the inner surface of the first tubular section in a suitable manner. Also, when the end portion of the counterpart terminal is inserted in the second tubular section, the outer surface of the counterpart terminal is in contact with the inner surface of the second tubular section in a suitable manner.

[5] The first tubular section preferably has an inner perimeter dimension that is smaller than an outer perimeter dimension of the end portion of the connection terminal. According to this configuration, when the end portion of the connection terminal is inserted into the first tubular section, the end portion of the connection terminal is press-fitted into the first tubular section. The outer surface of the connection terminal is thus in close contact with the inner surface of the first tubular section over its perimeter in the circumferential direction. This increases the area of contact between the outer surface of the connection terminal and the inner surface of the first tubular section.

[6] The second tubular section preferably has an inner perimeter dimension that is smaller than an outer perimeter dimension of the end portion of the counterpart terminal. According to this configuration, when the end portion of the counterpart terminal is inserted into the second tubular section, the end portion of the counterpart terminal is press-fitted into the second tubular section. The outer surface of the counterpart terminal is thus in close contact with the inner surface of the second tubular section over its perimeter in the circumferential direction. This increases the area of contact between the outer surface of the counterpart terminal and the inner surface of the second tubular section.

[7] The end portion of the connection terminal preferably has a guide section that is tapered toward a distal end surface that is located at a leading end in an insertion direction of the connection terminal relative to the joint portion. The guide section preferably extends from a middle section in a longitudinal direction of the connection terminal to the distal end surface.

According to this configuration, the section of the end portion of the connection terminal that is inserted into the joint portion first has the guide section that is thinner than the other section. This advantageously limits an increase in the insertion resistance of the connection terminal with respect to the joint portion at the beginning of the insertion of the connection terminal into the joint portion. Consequently, any misalignment or displacement relative to the joint portion can be corrected, allowing for the suitable insertion of the connection terminal into the joint portion.

[8] The connection terminal preferably has a shape of a quadrangular column. The connection terminal preferably has the distal end surface and four outer surfaces that are located around the distal end surface and connected to the distal end surface. The guide section preferably includes a first inclined surface that is located in each of the outer surfaces and continuously inclined toward the distal end surface.

According to this configuration, the first inclined surfaces are formed over the perimeter of the guide section in the circumferential direction. When the connection terminal is inserted into the joint portion, the first inclined surfaces of the guide section guide the section of the connection terminal that is located on the trailing side in the insertion direction of the guide section into the joint portion. As such, any misalignment or displacement relative to the joint portion can be corrected, allowing for the suitable insertion of the end portion of the connection terminal into the joint portion.

[9] The guide section preferably includes a second inclined surface that is located between adjacent ones of the first inclined surfaces and continuously inclined toward the distal end surface. According to this configuration, the second inclined surfaces are formed at the corners between adjacent first inclined surfaces. When the connection terminal is inserted into the joint portion, the first and second inclined surfaces of the guide section guide the section of the connection terminal that is located on the trailing side in the insertion direction of the guide section into the joint portion. As such, any misalignment or displacement relative to the joint portion can be corrected, allowing for the suitable insertion of the end portion of the connection terminal into the joint portion.

[10] The end portion of the connection terminal preferably includes an insertion section inserted in the joint portion and a non-insertion section that has a greater outer perimeter dimension than the insertion section and is not inserted in the joint portion. An outer surface of the non-insertion section, an end surface of the non-insertion section located at the insertion section, and an outer surface of the insertion section preferably form a step section. The end surface of the non-insertion section located at the insertion section is preferably in contact with an end surface of the joint portion. According to this configuration, the end surface of the joint portion is in contact with the end surface of the non-insertion section. This controls the amount of insertion of the connection terminal relative to the joint portion.

[11] When the joint portion is a first joint portion and the end portion of the connection terminal that is inserted in the first joint portion is a first end portion, the connection terminal preferably has a second end portion that is opposite to the first end portion in the longitudinal direction of the connection terminal. The terminal block preferably further includes a metal second joint portion that is tubular and in which the second end portion of the connection terminal is inserted.

According to this configuration, by inserting a counterpart terminal, to which the second end portion of the connection terminal is to be connected, into the second joint portion, the second end portion of the connection terminal is electrically connected to the counterpart terminal via the second joint portion. The electrical connection between the second end portion of the connection terminal and the counterpart terminal is thus achieved without using a connection tool such as a bolting tool. The space for a connection tool is therefore omitted, allowing the adjacent connection terminals to be arranged at smaller intervals. This limits an increase in size of the terminal block.

Details of Embodiments of Present Disclosure

Specific examples of a terminal block according to the present disclosure are now described with reference to the drawings. In the drawings, for convenience of explanation, some portions of the configurations may be exaggerated or simplified. In addition, portions may be drawn to different scales among the drawings. As used herein, the terms "parallel" and "perpendicular" not only indicate that the object is strictly parallel or perpendicular, but also encompass that the object is substantially parallel or perpendicular provided that the advantageous effect of the present embodiment is achieved. The present invention is not limited to the following examples, and it is intended that the present invention covers all modifications within the spirit and scope of the invention as defined in the claims and their equivalent.

A first embodiment of a connection device including a terminal block is now described. The connection device may be a device that electrically connects multiple electric devices to one another, such as a motor and an inverter mounted on a vehicle.

As shown in FIG. 1, a connection device 10 includes a case 11 of an electric device, a device terminal 20 provided in the case 11, a terminal block 30 coupled to the case 11, and a wire harness 70 connected to the terminal block 30. For example, the terminal block 30 relays the electrical connection between the device terminal 20 and a wire terminal 72 at an end of the wire harness 70.

Configuration of Case 11

The case 11 may have a box-shaped case main body 12 and a tubular mount portion 13, which is integral with the case main body 12 and projects inward of the case main body 12. As the material of the case 11, a metal material, such as an iron-based or aluminum-based metal, may be used. Depending on the type of the constituent metal and the use environment, surface treatment such as tin plating or aluminum plating may be applied to the case 11.

The mount portion 13 has a mount hole 14 extending through the mount portion 13 and is thus tubular. The mount hole 14 is formed to provide connection between the internal space of the case main body 12 and the external space of the case main body 12. The mount hole 14 may have a flat shape as viewed from the extension direction and has a longitudinal direction and a lateral direction. As used herein, the "flat shape" includes the shape of a rectangle, a stadium, and an ellipse, for example. The "rectangle" as used herein has long sides and short sides, and excludes a square. The "rectangle" as used herein includes a shape with chamfered ridges and a shape with rounded ridges. The "stadium" as used herein refers to a shape consisting of two parallel lines of substantially equal length and two semicircles. The mount hole 14 of the first embodiment is formed in a stadium shape as viewed from the extension direction.

The terminal block 30 can be mounted on the case 11 in any orientation according to the orientation of the mount portion 13. In the first embodiment, the structure of the terminal block 30 is described with reference to a height direction (up-down direction) extending in the extension direction of the mount hole 14. In the drawings, the X-axis of the XYZ axes represents the front-rear direction of the terminal block 30, the Y-axis represents the width direction of the terminal block 30 perpendicular to the X-axis, and the Z-axis represents the height direction of the terminal block 30 perpendicular to the XY plane. In the following description, for convenience, the direction extending along the X-axis is referred to as a front-rear direction X, the direction extending along the Y-axis is referred to as a width direction Y, and the direction extending along the Z-axis is referred to as a height direction Z. In the following description, the direction of arrow Z in FIG. 1 indicates upward.

Overall Configuration of Terminal Block 30

Figure 2:
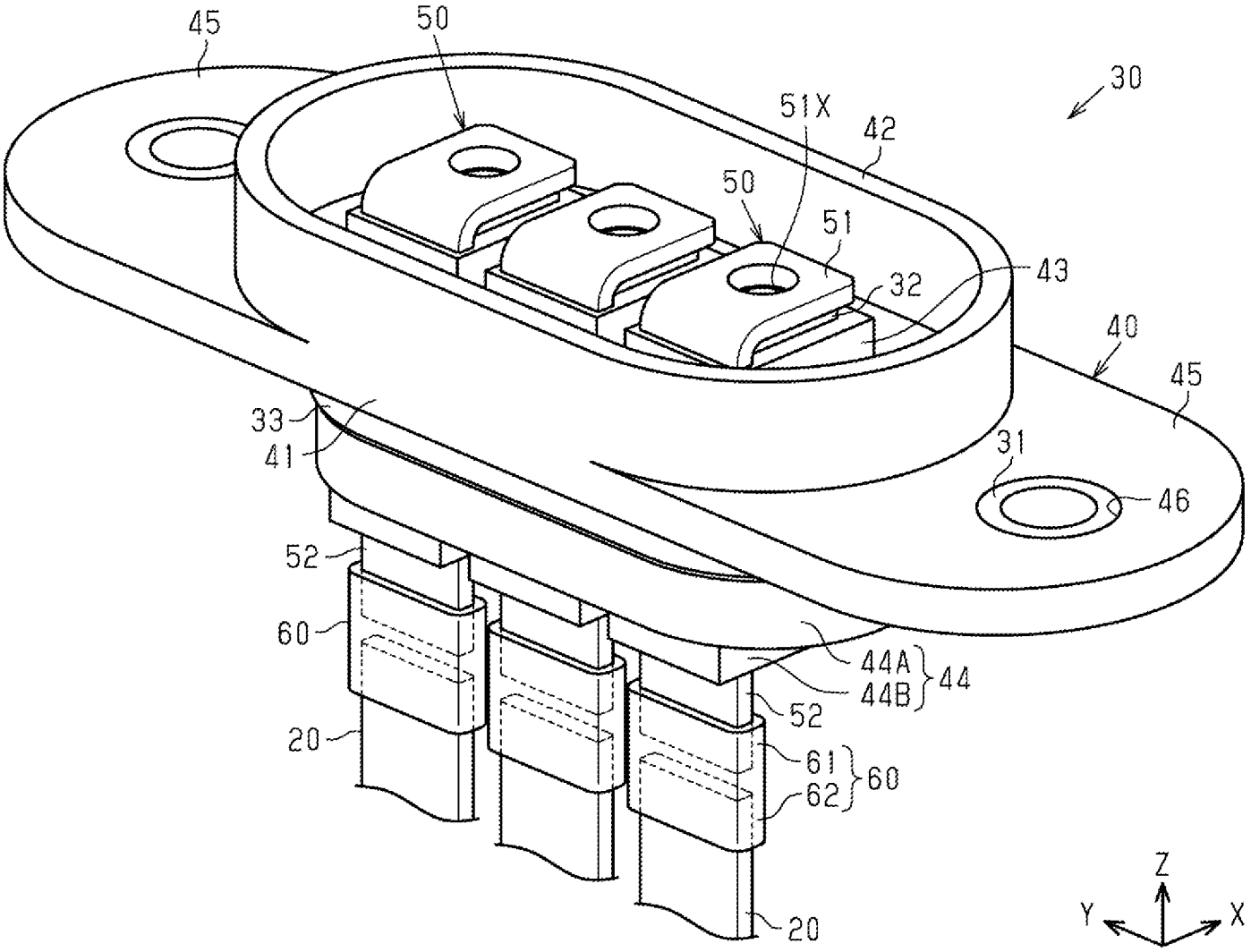
FIG. 2 is a schematic perspective view showing a terminal block of the first embodiment.

As shown in FIG. 2, the terminal block 30 may include a housing 40, which is made of a synthetic resin, multiple (three in this example) connection terminals 50, which are held in the housing 40, and tubular joint portions 60, in which end portions of the connection terminals 50 are inserted. The multiple connection terminals 50 may be arranged side by side in the width direction Y.

Configuration of Housing 40

The housing 40 may include a main body portion 41, a tubular hood portion 42, which is formed on the upper surface of the main body portion 41, multiple nut housing portions 43, which are provided in the hood portion 42, and an insertion portion 44, which is formed on the lower surface of the main body portion 41. The housing 40 may be a single component in which the main body portion 41, the hood portion 42, the nut housing portions 43, and the insertion portion 44 are integrally formed. The housing 40 is made of an insulating material such as a synthetic resin. As the synthetic resin, polyolefin, polyamide, polyester, polybutylene terephthalate, or the like may be used.

Configuration of Main Body Portion 41

The main body portion 41 may be planar. The main body portion 41 may have a predetermined thickness in the height direction Z and extend in the front-rear direction X and the width direction Y. The main body portion 41 of the first embodiment is formed in a stadium shape as viewed from the height direction Z.

The main body portion 41 may be formed so as to close the opening at one side in the axial direction of the hood portion 42. The main body portion 41 may include fixing sections 45 extending outward in the width direction Y from the hood portion 42. The fixing sections 45 may have through holes 46 extending through the fixing sections 45 in the plate thickness direction (the height direction Z in this example).

A metal collar 31, into which a fixing bolt (not shown) is insertable, is fitted to each through hole 46. The housing 40 may be fixed to the case 11 by threading fixing bolts (not shown) into the through holes 46 of the fixing sections 45 and fixing holes (not shown) formed in the case 11 (see FIG. 1). At this time, as shown in FIG. 1, the lower surface of the main body portion 41 may be in contact with the upper surface of the case 11.

Configuration of Hood Portion 42

As shown in FIG. 2, the hood portion 42 may project upward from the upper surface of the main body portion 41. The hood portion 42 may be formed so as to open upward. The hood portion 42 of the first embodiment is formed in a stadium shape as viewed from the height direction Z.

Configuration of Nut Housing Portion 43

The nut housing portions 43 may be provided corresponding to the connection terminals 50. The nut housing portions 43 may be formed inside the hood portion 42 and project upward from the upper surface of the main body portion 41. The multiple nut housing portions 43 may be arranged side by side in the width direction Y.

As shown in FIG. 1, each nut housing portion 43 may have a recess 43X formed to open upward. The recess 43X may extend downward from the upper surface of the nut housing portion 43. The recess 43X of the first embodiment is formed in a quadrangular shape as viewed from the height direction Z. A nut 32 is placed in the recess 43X from above. The nut 32 may be press-fitted into the recess 43X.

Configuration of Nut 32

Each nut 32 may have the shape of a polygonal column. The nut 32 of the first embodiment has the shape of a quadrangular column. The nut 32 has a through hole 32X extending in the insertion direction relative to the recess 43X of the nut housing portion 43 (the height direction Z in this example). The through hole 32X may be formed in a circular shape as viewed from the insertion direction of the nut 32.

Configuration of Insertion Portion 44

The insertion portion 44 may project downward from the lower surface of the main body portion 41. The insertion portion 44 may include a base portion 44A and terminal holding portions 44B projecting downward from the base portion 44A. The insertion portion 44 is inserted (fitted) into the mount hole 14 of the case 11 in an insertion direction D1. The insertion direction D1 of the first embodiment is a direction parallel to the height direction Z and is a direction from the upper side to the lower side of the height direction Z.

The base portion 44A is provided on the trailing side (the upper side as viewed in the figure) in the insertion direction D1 of the insertion portion 44. The outer surface of the base portion 44A may have the shape corresponding to the inner surface of the mount hole 14. The base portion 44A may have a stadium-shaped outer perimeter and extend in the height direction Z. The base portion 44A may have the shape of a stadium-shaped column. The outer surface of the base portion 44A may come into contact with the inner surface of the mount hole 14 when the insertion portion 44 is inserted into the mount hole 14.

The terminal holding portions 44B are provided on the leading side (the lower side in the figure) in the insertion direction D1 of the insertion portion 44. The terminal holding portions 44B may project downward from the lower surface of the base portion 44A. As shown in FIG. 2, the terminal holding portions 44B may be provided corresponding to the connection terminals 50. The multiple terminal holding portions 44B may be arranged side by side in the width direction Y.

As shown in FIG. 1, each terminal holding portion 44B has a holding hole 47 extending through the terminal holding portion 44B in the height direction Z. The holding hole 47 extends through the base portion 44A and the nut housing portion 43 in the height direction Z. The holding hole 47 holds the connection terminal 50. In the terminal block 30, the connection terminals 50 may be integral with the housing 40. For example, the connection terminals 50 are coupled integrally with the housing 40 by insert molding.

For example, the outer surface of the insertion portion 44 has a housing groove 44X, which houses a rubber ring 33. The housing groove 44X extends from the outer surface of the base portion 44A radially inward of the base portion 44A. The housing groove 44X may be formed over the entire circumference of the outer surface of the base portion 44A. The rubber ring 33 is fitted into the housing groove 44X. When the insertion portion 44 is inserted into the mount hole 14, the rubber ring 33 is in close contact with the inner surface of the mount hole 14 over its entire circumference to provide water seal between the outer surface of the housing 40 and the inner surface of the case 11.

Configuration of Rubber Ring 33

The rubber ring 33 is elastically deformable. The rubber ring 33 may extend continuously over the entire circumference of the insertion portion 44 to form a closed ring. The rubber ring 33 may be an O-ring. The shape of the inner circumference of the rubber ring 33 may conform to the shape of the outer surface of the insertion portion 44. The shape of the outer circumference of the rubber ring 33 may conform to the shape of the inner surface of the mount hole 14. The rubber ring 33 of the first embodiment is formed into a stadium-shaped tube with stadium-shaped inner and outer circumferences. The outer diameter of the rubber ring 33 is greater than the outer diameter of the insertion portion 44, and also greater than the inner diameter of the mount hole 14.

Examples of the material of the rubber ring 33 include nitrile rubber, silicone rubber, urethane rubber, acrylic rubber, butyl rubber, and ethylene propylene rubber.

Configuration of Connection Terminal 50

Each connection terminal 50 may be columnar. Each connection terminal 50 may include a wire connection portion 51, which is to be connected to a wire terminal 72, a device connection portion 52, which is to be connected to a device terminal 20, and a middle portion 53, which is located between the wire connection portion 51 and the device connection portion 52. Each connection terminal 50 may be a single component in which the wire connection portion 51, the middle portion 53, and the device connection portion 52 are continuously and integrally formed. As the material of the connection terminals 50, a metal material, such as an iron-based or aluminum-based metal, may be used. Depending on the type of the constituent metal and the use environment, surface treatment such as tin plating or aluminum plating may be applied to the connection terminals 50.

Each connection terminal 50 may be formed in an L shape as a whole. The middle portion 53 may extend in the height direction Z. The middle portion 53 may extend linearly in the height direction Z. In one example, the middle portion 53 has the shape of a flat plate. In one example, the middle portion 53 has the shape of a quadrangular column. The shape of a cross-section of the middle portion 53 of the first embodiment that is perpendicular to the longitudinal direction of the middle portion 53 (that is, the shape of a lateral cross-section) may be rectangular. The lateral cross-sectional shape of the middle portion 53 of the first embodiment is the shape of a rectangle having long sides extending in the width direction Y and short sides extending in the front-rear direction X.

Configuration of Wire Connection Portion 51

The wire connection portion 51 may be located at the upper end of the middle portion 53. The wire connection portion 51 may extend from the upper end of the middle portion 53 in the front-rear direction X. The wire connection portion 51 may extend perpendicular to the longitudinal direction of the middle portion 53. The wire connection portion 51 may be perpendicular to the middle portion 53. The wire connection portion 51 may have the shape of a flat plate. The wire connection portion 51 has a bolt insertion hole 51X, into which the shaft of a bolt (not shown) is inserted. The bolt insertion hole 51X extends through the wire connection portion 51 in the plate thickness direction (the height direction Z in this example). The wire connection portion 51 is placed on the upper surface of the nut 32. At this time, the bolt insertion hole 51X is aligned with the through hole 32X of the nut 32 in plan view as viewed from the height direction Z. For example, the bolt insertion hole 51X may be arranged so as to be coaxial with the through hole 32X of the nut 32.

Configuration of Device Connection Portion 52

The device connection portion 52 may be connected to the lower end of the middle portion 53. The device connection portion 52 may extend from the lower end of the middle portion 53 in the height direction Z. The device connection portion 52 may extend linearly in the height direction Z. The device connection portion 52 may extend parallel to the longitudinal direction of the middle portion 53. The device connection portion 52 may project downward from the lower surface of the terminal holding portion 44B. In the following description, for convenience, the portion of the connection terminal 50 that projects downward from the lower surface of the terminal holding portion 44B is referred to as a device connection portion 52.

In one example, the device connection portion 52 has the shape of a flat plate. In one example, the device connection portion 52 has the shape of a polygonal column. In one example, the device connection portion 52 has the shape of a quadrangular column. The lateral cross-sectional shape of the device connection portion 52 of the first embodiment is rectangular. The lateral cross-sectional shape of the device connection portion 52 of the first embodiment is the shape of a rectangle having long sides extending in the width direction Y and short sides extending in the front-rear direction X.

The distal end portion (the lower end portion in this example) of each device connection portion 52 may be inserted in a tubular joint portion 60. The distal end portion of the device connection portion 52 may be inserted into the joint portion 60 in an insertion direction D2. The insertion direction D2 of the first embodiment is a direction parallel to the height direction Z and is a direction from the upper side to the lower side of the height direction Z. The insertion direction D2 of the first embodiment is parallel to the insertion direction D1 of the insertion portion 44 relative to the mount hole 14. The distal end portion of the device connection portion 52 may be press-fitted into the joint portion 60.

Configuration of Joint Portion 60

The joint portions 60 may be arranged in correspondence with the connection terminals 50 (the device connection portions 52). Each joint portion 60 may have the shape of a polygonal tube or a circular tube. The joint portion 60 may include a tubular section 61, in which the distal end portion of the device connection portion 52 is inserted, and a tubular section 62, in which the distal end portion of the device terminal 20 is inserted. The joint portion 60 may be a single component in which the tubular sections 61 and 62 are integrally formed. In the joint portion 60, the internal space of the tubular section 61 may connect to the internal space of the tubular section 62. In the joint portion 60, the inner surfaces of the tubular sections 61 and 62 may be continuously formed without a step. For example, the inner perimeters of the tubular sections 61 and 62 are identical in shape. As the material of the joint portions 60, a metal material, such as an iron-based or aluminum-based metal, may be used. Depending on the type of the constituent metal and the use environment, surface treatment such as tin plating or aluminum plating may be applied to the joint portions 60.

Configuration of Device Connection Portion 52 and Joint Portion 60

Figure 3:
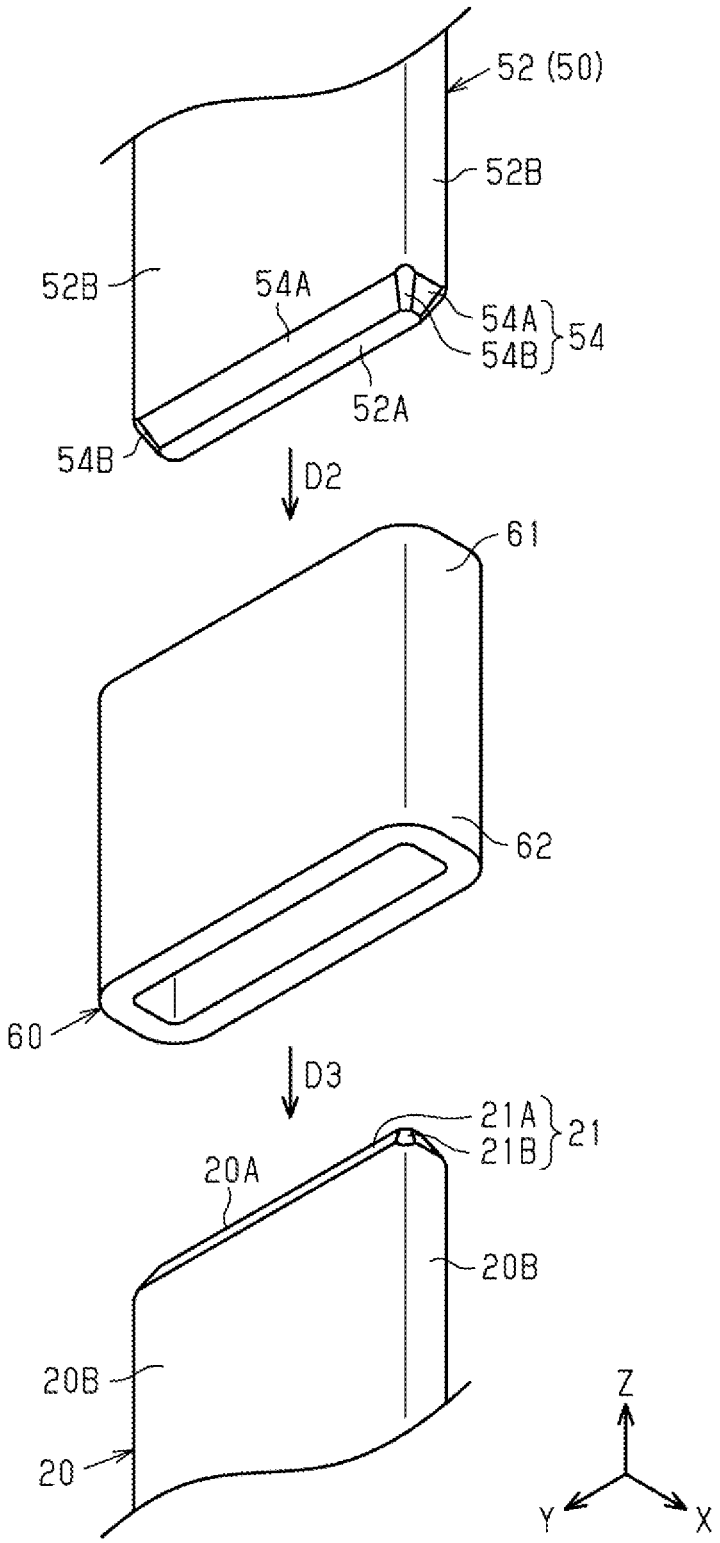
FIG. 3 is a schematic perspective view showing a part of a connection device of the first embodiment.

As shown in FIG. 3, the outer perimeter shape of the device connection portion 52 may correspond to the inner perimeter shape of the tubular section 61 of the joint portion 60. The outer perimeter shape of the device connection portion 52 may be mathematically similar to the inner perimeter shape of the tubular section 61. For example, the device connection portion 52 may have the shape of a quadrangular column (the shape of a rectangular prism) and have a rectangular outer perimeter. For example, the tubular section 61 has the shape of a quadrangular tube having rectangular inner and outer perimeters. The device connection portion 52 may include a distal end surface 52A, which is located at the leading end in the insertion direction D2 of the device connection portion 52 relative to the tubular section 61, and four outer surfaces 52B, which are located around the distal end surface 52A and connected to the distal end surface 52A. The four outer surfaces 52B form the rectangular shape described above.

The outer perimeter dimension of the device connection portion 52 may be greater than the inner perimeter dimension of the tubular section 61. In other words, the inner perimeter dimension of the tubular section 61 may be smaller than the outer perimeter dimension of the device connection portion 52. This provides the press-fitting allowance when the device connection portion 52 is press-fitted into the tubular section 61. When the distal end portion of the device connection portion 52 is press-fitted into the tubular section 61, the outer surfaces 52B of the device connection portion 52 are in close contact with the inner surfaces of the tubular section 61 over its perimeter in the circumferential direction. As used herein, the "outer perimeter dimension of member A" refers to the length of the outer surface over its perimeter in the circumferential direction of member A. For example, when the lateral cross-sectional shape of member A is rectangular, the outer perimeter dimension of member A is the sum of the two long sides and the two short sides of the rectangle. Also, the "inner perimeter dimension of A member" as used herein refers to the length of the inner surface over its perimeter in the circumferential direction.

The distal end portion of the device connection portion 52 may include a tapered guide section 54. The guide section 54 may be tapered toward the distal end surface 52A of the device connection portion 52. The guide section 54 may extend from a position in the longitudinal direction of the device connection portion 52 to the distal end surface 52A. The outer perimeter dimension of the guide section 54 is smaller than the outer perimeter dimension of the section of the device connection portion 52 other than the guide section 54. The most part of the guide section 54 may have an outer perimeter dimension that is smaller than the inner perimeter dimension of the tubular section 61. When the device connection portion 52 is press-fitted into the tubular section 61, the guide section 54 functions to guide the section of the device connection portion 52 other than the guide section 54 into the tubular section 61.

The guide section 54 may have inclined surfaces 54A, which are continuously inclined toward the distal end surface 52A of the device connection portion 52. The inclined surfaces 54A may be inclined from a middle section in the longitudinal direction of the device connection portion 52 so as to be closer to the central axis of the device connection portion 52 toward the distal end surface 52A. The inclined surfaces 54A may be formed corresponding to all four outer surfaces 52B. That is, the guide section 54 of the first embodiment has four inclined surfaces 54A. The inclined surfaces 54A may be formed by removing the sharp corners between the distal end surface 52A and the outer surfaces 52B. Specifically, the corners may be rounded or chamfered. The inclined surfaces 54A of the first embodiment are formed by chamfering the corners between the distal end surface 52A and the outer surfaces 52B.

The guide section 54 may have inclined surfaces 54B formed between adjacent inclined surfaces 54A. In the guide section 54 of the first embodiment, the inclined surfaces 54B are formed at all four corners between adjacent inclined surfaces 54A. That is, the guide section 54 of the first embodiment has four inclined surfaces 54B. As described above, the guide section 54 of the first embodiment consists of four inclined surfaces 54A and four inclined surfaces 54B. The inclined surface 54B may be formed so as to be continuously inclined toward the distal end surface 52A of the device connection portion 52. The inclined surfaces 54B may be inclined from a middle section in the longitudinal direction of the device connection portion 52 so as to be closer to the central axis of the device connection portion 52 toward the distal end surface 52A. Each inclined surface 54B may decrease in width from the middle section in the longitudinal direction of the device connection portion 52 toward the distal end surface 52A. The inclined surfaces 54B may be formed by removing sharp corners between adjacent inclined surfaces 54A. Specifically, the corners may be rounded or chamfered. The inclined surfaces 54B of the first embodiment are formed by chamfering the corners between adjacent inclined surfaces 54A.

As shown in FIG. 1, the distal end portion of the device connection portion 52 is press-fitted into the tubular section 61 by a predetermined length so that a predetermined area of the outer surfaces 52B of the device connection portion 52 is in close contact with the inner surfaces of the tubular section 61. The close contact between the outer surfaces 52B of the device connection portion 52 and the inner surfaces of the tubular section 61 electrically connects the device connection portion 52 to the tubular section 61.

Configuration of Device Terminal 20

Device terminals 20 are provided in the internal space of the case 11. The device terminals 20 may be fixed in the case 11. As shown in FIG. 2, the device terminals 20 may be arranged in correspondence with the connection terminals 50 and the joint portions 60.

The device terminals 20 may extend in the height direction Z. The device terminals 20 may extend linearly in the height direction Z. The device terminals 20 may extend parallel to the longitudinal direction of the device connection portions 52. A metal material, such as an iron-based or aluminum-based metal, may be used as the material of the device terminals 20. Depending on the type of the constituent metal and the use environment, surface treatment such as tin plating or aluminum plating may be applied to the device terminals 20.

In one example, each device terminal 20 has the shape of a flat plate. In one example, the device terminal 20 has the shape of a polygonal column. In one example, the device terminal 20 has the shape of a quadrangular column. The lateral cross-sectional shape of the device terminal 20 of the first embodiment is rectangular. The lateral cross-sectional shape of the device terminal 20 of the first embodiment is the shape of a rectangle having long sides extending in the width direction Y and short sides extending in the front-rear direction X.

As shown in FIG. 1, the distal end portion (the upper end portion in this example) of each device terminal 20 may be inserted in a joint portion 60. The distal end portion of the device terminal 20 may be inserted into the joint portion 60 in an insertion direction D3. The insertion direction D3 of the first embodiment is a direction parallel to the height direction Z and is a direction from the upper side to the lower side of the height direction Z. The insertion direction D3 of the first embodiment is parallel to the insertion direction D1 of the insertion portion 44 relative to the mount hole 14. The distal end portion of the device terminal 20 may be press-fitted into the joint portion 60.

Configuration of Device Terminal 20 and Joint Portion 60

As shown in FIG. 3, the inner perimeter shape of the tubular section 62 of each joint portion 60 may correspond to the outer perimeter shape of the device terminal 20. The inner perimeter shape of the tubular section 62 may be mathematically similar to the outer perimeter shape of the device terminal 20. For example, the tubular section 62 may have the shape of a quadrangular tube having rectangular inner and outer perimeters. For example, the device terminal 20 may have the shape of a quadrangular column (the shape of a rectangular prism) and have a rectangular outer perimeter. The device terminal 20 may include a distal end surface 20A, which is located at the leading end in the insertion direction D3 of the device terminal 20 relative to the tubular section 62, and four outer surfaces 20B, which are located around the distal end surface 20A and connected to the distal end surface 20A. The four outer surfaces form the rectangular shape described above.

The inner perimeter dimension of the tubular section 62 may be smaller than the outer perimeter dimension of the device terminal 20. This provides the press-fitting allowance when the device terminal 20 is press-fitted into the tubular section 62. When the distal end portion of the device terminal 20 is press-fitted into the tubular section 62, the outer surfaces 20B of the device terminal 20 are in close contact with the inner surfaces of the tubular section 62 over its perimeter in the circumferential direction.

The distal end portion of the device terminal 20 may include a tapered guide section 21. The guide section 21 may be tapered toward the distal end surface 20A of the device terminal 20. The guide section 21 may extend from a position in the longitudinal direction of the device terminal 20 to the distal end surface 20A. The outer perimeter dimension of the guide section 21 is smaller than the outer perimeter dimension of the section of the device terminal 20 other than the guide section 21. The most part of the guide section 21 may have an outer perimeter dimension that is smaller than the inner perimeter dimension of the tubular section 62. When the device terminal 20 is press-fitted into the tubular section 62, the guide section 21 functions to guide the section of the device terminal 20 other than the guide section 21 into the tubular section 62.

The guide section 21 may have inclined surfaces 21A, which are continuously inclined toward the distal end surface 20A of the device terminal 20. The inclined surfaces 21A may be inclined from a middle section in the longitudinal direction of the device terminal 20 so as to be closer to the central axis of the device terminal 20 toward the distal end surface 20A. The inclined surfaces 21A may be formed corresponding to all four outer surfaces 20B. That is, the guide section 21 of the first embodiment has four inclined surfaces 21A. The inclined surfaces 21A may be formed by removing sharp corners between the distal end surface 20A and the outer surfaces 20B. Specifically, the corners may be rounded or chamfered. The inclined surfaces 21A of the first embodiment are formed by chamfering the corners between the distal end surface 20A and the outer surfaces 20B.

The guide section 21 may have inclined surfaces 21B formed between adjacent inclined surfaces 21A. In the guide section 21 of the first embodiment, the inclined surfaces 21B are formed at all four corners between adjacent inclined surfaces 21A. That is, the guide section 21 of the first embodiment has four inclined surfaces 21B. As described above, the guide section 21 of the first embodiment consists of four inclined surfaces 21A and four inclined surfaces 21B. The inclined surfaces 21B may be formed so as to be continuously inclined toward the distal end surface 20A of the device terminal 20. The inclined surfaces 21B are inclined from a middle section in the longitudinal direction of the device terminal 20 so as to be closer to the central axis of the device terminal 20 toward the distal end surface 20A. Each inclined surface 21B may decrease in width from the middle section in the longitudinal direction of the device terminal 20 toward the distal end surface 20A. The inclined surfaces 21B may be formed by removing sharp corners between adjacent inclined surfaces 21A. Specifically, the corners may be rounded or chamfered. The inclined surfaces 21B of the first embodiment are formed by chamfering the corners between adjacent inclined surfaces 21A.

As shown in FIG. 1, the distal end portion of the device terminal 20 is press-fitted into the tubular section 62 by a predetermined length so that a predetermined area of the outer surfaces 20B of the device terminal 20 is in close contact with the inner surfaces of the tubular section 62. The close contact between the outer surfaces 20B of the device terminal 20 and the inner surfaces of the tubular section 62 electrically connects the device terminal 20 to the tubular section 62. The device terminal 20 is thus electrically connected to the device connection portion 52 via the joint portion 60.

Configuration of Wire Harness 70

The wire harness 70 may include wires (not shown) and a wire connector 71 connected to end portions of the wires. The connector 71 includes wire terminals 72 electrically connected to the wires and connector housings 73 holding the wire terminals 72. The connector 71 may include the wire terminals 72 in the same number as the connection terminals 50 of the terminal block 30 (three in this example). In the connector 71, the multiple wire terminals 72 may be integral with the connector housing 73. For example, the multiple wire terminals 72 are coupled integrally with the connector housing 73 by insert molding. The connector housing 73 may be made of an insulating material such as a synthetic resin. As the synthetic resin, polyolefin, polyamide, polyester, polybutylene terephthalate, or the like may be used.

Each wire terminal 72 may have the shape of a flat plate bent in a crank form. The wire terminal 72 may have a connection portion 74 projecting from the connector housing 73. The connection portion 74 may extend in the front-rear direction X. The connection portion 74 may extend parallel to the longitudinal direction of the wire connection portion 51 of the connection terminal 50. The connection portion 74 has a bolt insertion hole 74X, into which the shaft of a bolt (not shown) is inserted. The bolt insertion hole 74X extends through the connection portion 74 in the plate thickness direction (the height direction Z in this example). The connection portion 74 is laid on the upper surface of the wire connection portion 51. At this time, the bolt insertion hole 74X is aligned with the bolt insertion hole 51X of the wire connection portion 51 and the through hole 32X of the nut 32 in plan view as viewed from the height direction Z. For example, the bolt insertion hole 74X may be arranged so as to be coaxial with the bolt insertion hole 51X and the through hole 32X. With the connection portion 74 laid on the upper surface of the wire connection portion 51, the shaft of a bolt (not shown) is inserted into the bolt insertion holes 74X and 51X and the through hole 32X from above, bolting the connection portion 74 to the wire connection portion 51. This electrically connects the connection portion 74 to the wire connection portion 51.

Manufacturing Method of Connection Device 10

A method for manufacturing a connection device 10 is now described.

Figure 4:
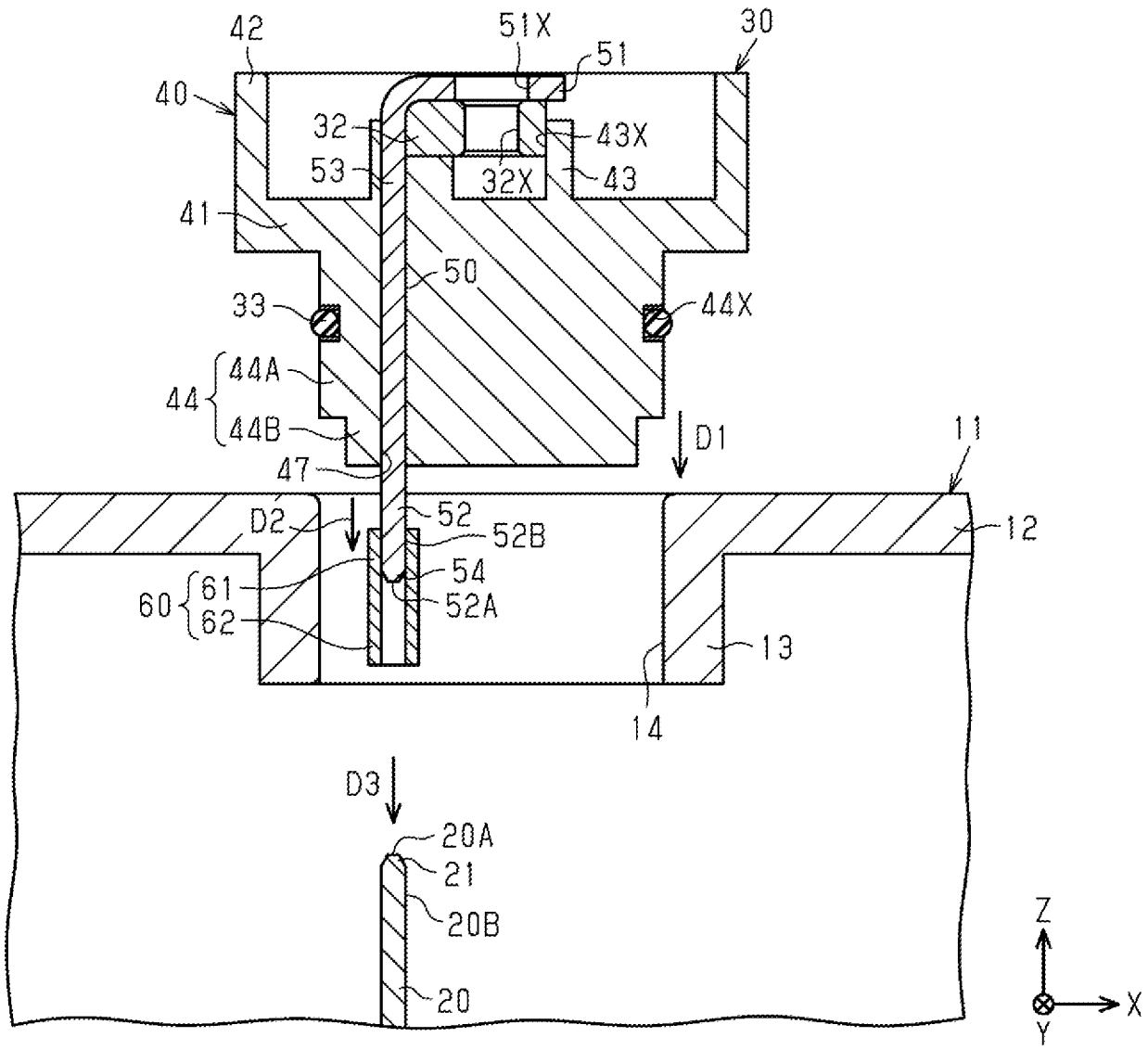
FIG. 4 is a schematic cross-sectional view showing a connection device during installation of a terminal block on a case of the first embodiment.

In the connection device 10 shown in FIG. 4, a terminal block 30 and a case 11 having device terminals 20 therein are prepared. At this time, with the terminal block 30, the distal end portion of the device connection portion 52 of each connection terminal 50 is press-fitted into the tubular section 61 of a joint portion 60. For example, the distal end portion of the device connection portion 52 of the connection terminal 50 held in the housing 40 is inserted in the insertion direction D2 into the tubular section 61 of the joint portion 60 fixed by a fixing jig (not shown). At this time, the guide section 54 of the device connection portion 52 is inserted into the tubular section 61. The guide section 54 has an outer perimeter dimension that is smaller than the inner perimeter dimension of the tubular section 61. This limits an increase in the insertion resistance of the device connection portion 52 with respect to the tubular section 61 at the beginning of the insertion of the device connection portion 52 into the tubular section 61. The distal end portion (that is, the guide section 54) of the device connection portion 52 is thus easily inserted into the tubular section 61. Then, as the distal end portion of the device connection portion 52 is further inserted into the tubular section 61 in the insertion direction D2, the inclined surfaces 54A and 54B of the guide section 54 (FIG. 3) guide the device connection portion 52 into the tubular section 61. This allows the section of the device connection portion 52 that is on the trailing side of the guide section 54 in the insertion direction D2 to be press-fitted into the tubular section 61 in a suitable manner. The outer surfaces 52B of the device connection portion 52 are therefore brought into close contact with the inner surface of the tubular section 61, electrically connecting the device connection portion 52 to the joint portion 60. Furthermore, the joint portion 60 may be fixed to the device connection portion 52.

In the connection device 10 shown in FIG. 4, the terminal block 30, which has a structure in which the distal end portion of the device connection portion 52 is press-fitted into the tubular section 61, is placed over the case 11 such that the insertion portion 44 is aligned with the mount hole 14 of the case 11 in plan view as viewed from the height direction Z. At this time, the internal space of the tubular section 62 of the joint portion 60 is aligned with the device terminal 20 in plan view as viewed from the height direction Z.

Then, the insertion portion 44 of the terminal block 30 is inserted into the mount hole 14 in the insertion direction D1. The insertion direction D1 of the insertion portion 44 relative to the mount hole 14 is the same as the insertion direction D3 of the device terminal 20 relative to the joint portion 60. As such, when the insertion portion 44 is inserted into the mount hole 14, the distal end portion of the device terminal 20 may be simultaneously inserted (press-fitted) into the tubular section 62 of the joint portion 60 in the insertion direction D3. At this time, in the same manner as the press-fitting of the device connection portion 52 into the tubular section 61, the guide section 21, which has an outer perimeter dimension that is smaller than the inner perimeter dimension of the tubular section 62, is inserted into the tubular section 62.

Figure 5:
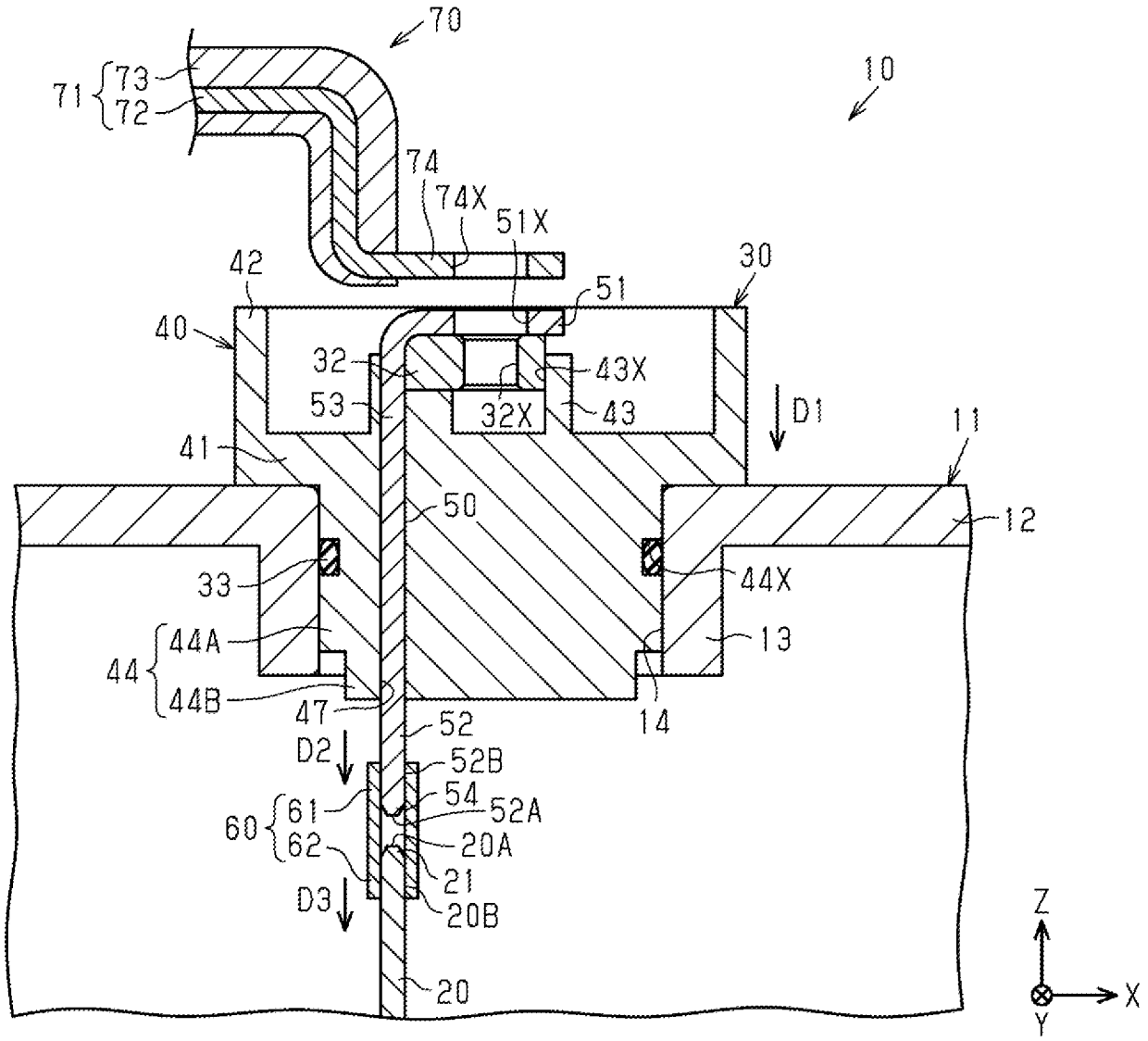
FIG. 5 is a schematic cross-sectional view showing a connection device during installation of a wire harness on a terminal block of the first embodiment.

Then, as shown in FIG. 5, as the insertion portion 44 is further inserted into the mount hole 14 in the insertion direction D1, the distal end portion of the device terminal 20 is further inserted into the tubular section 62 in the insertion direction D3. At this time, the inclined surfaces 21A and 21B (see FIG. 3) of the guide section 21 guide the device terminal 20 into the tubular section 62. This allows the section of the device terminal 20 that is located below the guide section 21 to be press-fitted into the tubular section 62 in a suitable manner. The outer surfaces 20B of the device terminal 20 are therefore brought into close contact with the inner surface of the tubular section 62, electrically connecting the device terminal 20 to the joint portion 60. Consequently, the device connection portion 52 is electrically connected to the device terminal 20 via the joint portion 60. As described above, with the terminal block 30 of the first embodiment, the device terminal 20 is press-fitted into the tubular section 62 concurrently with the action of inserting the insertion portion 44 into the mount hole 14 of the case 11, so as to electrically connect the device connection portion 52 to the device terminal 20.

Then, fixing bolts (not shown) are threaded into the through holes 46 of the fixing sections 45 shown in FIG. 2 and fixing holes (not shown) in the case 11 to fix the terminal block 30 to the case 11.

Then, in the connection device 10 shown in FIG. 5, the connector 71 of the wire harness 70 is placed over the terminal block 30 such that the connection portion 74 of the wire terminal 72 is aligned with the wire connection portion 51 of the connection terminal 50 in plan view as viewed from the height direction Z. Then, the connection portion 74 is laid on the upper surface of the wire connection portion 51, and the shaft of a bolt (not shown) is inserted into the bolt insertion holes 74X and 51X and the through hole 32X from above, bolting the connection portion 74 to the wire connection portion 51. This electrically connects the connection portion 74 to the wire connection portion 51. The wire terminal 72 is thus electrically connected to the device terminal 20 via the connection terminal 50 and the joint portion 60.

The advantageous effects of the first embodiment are now described.

(1) The terminal block 30 includes a housing 40, which is made of a synthetic resin, metal connection terminals 50, which are columnar and held in the housing 40, and metal joint portions 60, which are tubular and in which the distal end portions of the device connection portions 52 of the connection terminals 50 are inserted.

According to this configuration, by inserting the device terminals 20, to which the device connection portions 52 of the connection terminals 50 are to be connected, into the joint portions 60, the device connection portions 52 are electrically connected to the device terminals 20 via the joint portions 60. The electrical connection between the device connection portions 52 and the device terminals 20 is thus achieved without using a connection tool such as a bolting tool. The space for a connection tool is therefore omitted, allowing the adjacent device connection portions 52 to be arranged at smaller intervals. This limits an increase in size of the terminal block 30.

(2) The inner perimeter shape of the tubular section 61 is mathematically similar to the outer perimeter shape of the distal end portion of the device connection portion 52, and the inner perimeter shape of the tubular section 62 is mathematically similar to the outer perimeter shape of the end portion of the device terminal 20. According to this configuration, the similar shapes of the inner perimeter of the tubular section 61 and the outer perimeter of the distal end portion of the device connection portion 52 allow the outer surface of the distal end portion of the device connection portion 52 to be in contact with the inner surface of the tubular section 61 in a suitable manner when the distal end portion of the device connection portion 52 is inserted into the tubular section 61. This increases the area of contact between the outer surface of the device connection portion 52 and the inner surface of the tubular section 61. Furthermore, the mathematically similar shapes of the inner perimeter of the tubular section 62 and the outer perimeter of the end portion of the device terminal 20 allow the outer surface of the device terminal 20 to be in contact with the inner surface of the tubular section 62 in a suitable manner when the end portion of the device terminal 20 is inserted into the tubular section 62. This increases the area of contact between the outer surface of the device terminal 20 and the inner surface of the tubular section 62.

(3) The inner perimeter dimension of the tubular section 61 is smaller than the outer perimeter dimension of the distal end portion of the device connection portion 52. According to this configuration, when the distal end portion of the device connection portion 52 is inserted into the tubular section 61, the distal end portion of the device connection portion 52 is press-fitted into the tubular section 61. The outer surface of the device connection portion 52 is thus in close contact with the inner surface of the tubular section 61 over its perimeter in the circumferential direction. This increases the area of contact between the outer surface of the device connection portion 52 and the inner surface of the tubular section 61.

(4) The inner perimeter dimension of the tubular section 62 is smaller than the outer perimeter dimension of the distal end portion of the device terminal 20. According to this configuration, when the distal end portion of the device terminal 20 is inserted into the tubular section 62, the distal end portion of the device terminal 20 is press-fitted into the tubular section 62. The outer surface of the device terminal 20 is thus in close contact with the inner surface of the tubular section 62 over its perimeter in the circumferential direction. This increases the area of contact between the outer surface of the device terminal 20 and the inner surface of the tubular section 62.

(5) The distal end portion of the device connection portion 52 has the guide section 54, which tapers toward the distal end surface 52A located at the leading end in the insertion direction D2 of the device connection portion 52 relative to the joint portion 60. The guide section 54 extends from a middle section in the longitudinal direction of the device connection portion 52 to the distal end surface 52A.

According to this configuration, the section of the distal end portion of the device connection portion 52 that is first inserted into the joint portion 60 has the guide section 54, which is thinner than the other section. This advantageously limits an increase in the insertion resistance of the device connection portion 52 with respect to the joint portion 60 at the beginning of the insertion of the device connection portion 52 into the joint portion 60. Consequently, any misalignment or displacement relative to the joint portion 60 can be corrected, allowing for the suitable insertion of the device connection portion 52 into the joint portion 60.

(6) The guide section 54 has the inclined surfaces 54A, which are formed in the outer surfaces 52B and continuously inclined toward the distal end surface 52A. According to this configuration, the inclined surfaces 54A are formed over the perimeter of the guide section 54 in the circumferential direction. When the device connection portion 52 is inserted into the joint portion 60, the inclined surfaces 54A of the guide section 54 guide the section of the device connection portion 52 that is located on the trailing side in the insertion direction D2 of the guide section 54 into the joint portion 60. Consequently, any misalignment or displacement relative to the joint portion 60 can be corrected, allowing for the suitable insertion of the distal end portion of the device connection portion 52 into the joint portion 60.

(7) The guide section 54 has the inclined surfaces 54B, which are formed between adjacent inclined surfaces 54A and continuously inclined toward the distal end surface 52A. According to this configuration, the inclined surfaces 54B are formed at the corners between adjacent inclined surfaces 54A. When the device connection portion 52 is inserted into the joint portion 60, the inclined surfaces 54A and the inclined surfaces 54B of the guide section 54 guide the section of the device connection portion 52 that is located on the trailing side in the insertion direction D2 of the guide section 54 into the joint portion 60. Consequently, any misalignment or displacement relative to the joint portion 60 can be corrected, allowing for the suitable insertion of the distal end portion of the device connection portion 52 into the joint portion 60.

The first embodiment may be modified and implemented as follows. The first embodiment and the following embodiments may be combined to the extent that does not cause technical contradiction.

In the above embodiments, the electrical connection between the wire connection portion 51 of the connection terminal 50 and the wire terminal 72 is provided by bolting, but the wire connection portion 51 and the wire terminal 72 may be connected by other techniques.

Figure 6:
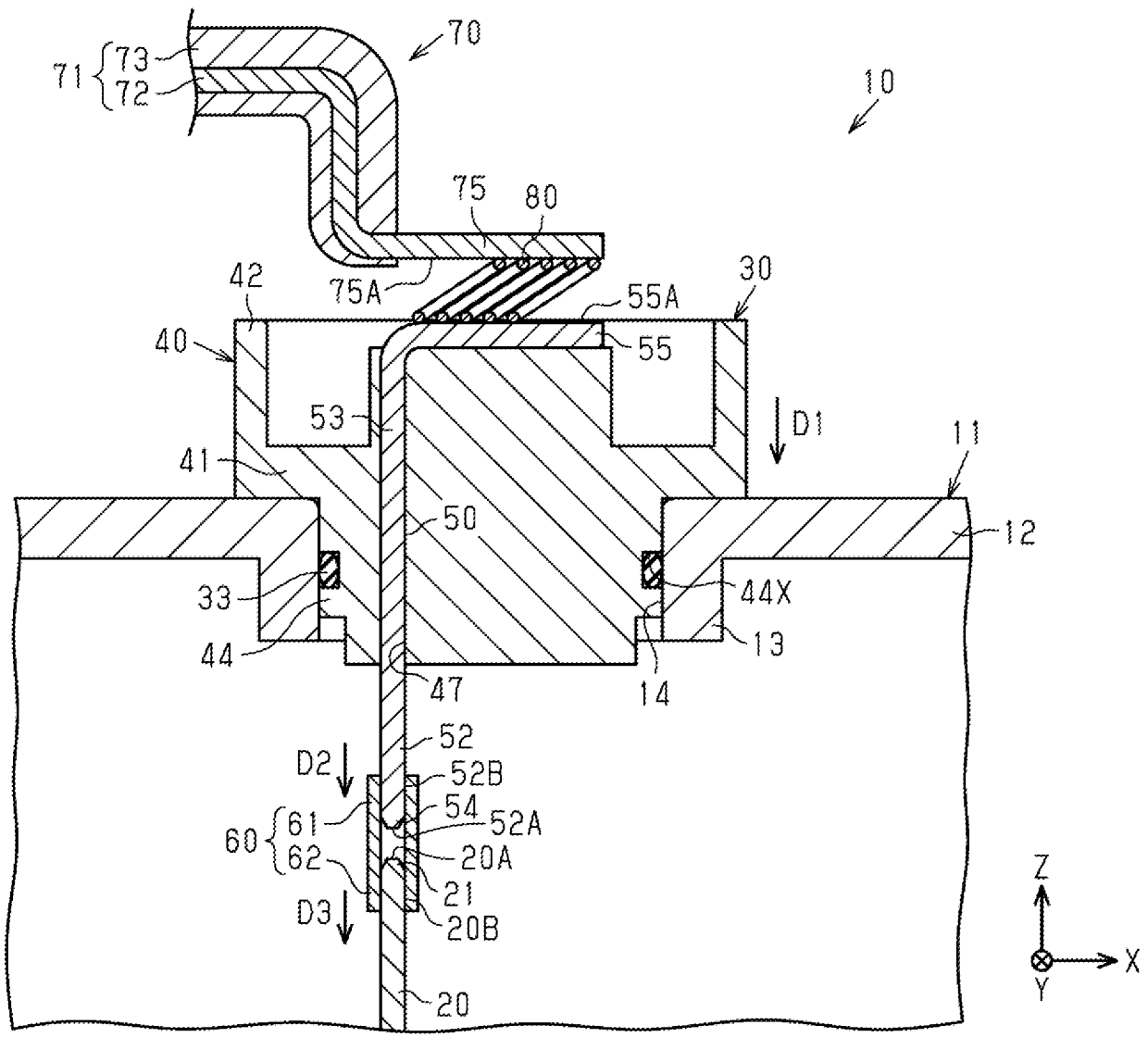
FIG. 6 is a schematic cross-sectional view showing a connection device of a second embodiment.

For example, in a second embodiment, as shown in FIG. 6, a spring member 80 may be placed between the wire connection portion 55 of the connection terminal 50 and the wire terminal 72, and the spring member 80 may electrically connect the wire connection portion 55 to the wire terminal 72. The wire connection portion 55 may have a flat contact surface 55A. The connection portion 75 of the wire terminal 72 may have a flat contact surface 75A. The contact surface 55A of the wire connection portion 55 and the contact surface 75A of the connection portion 75 face each other, and the spring member 80 is placed between the contact surfaces 55A and 75A. The spring member 80 may be a helical coil spring. The helical coil spring may be formed by winding a wire of a conductive spring material in a spiral so that the turns are inclined with respect to the coil axis. The spring member 80 may be compressed between the contact surfaces 55A and 75A.

An example of a technique for connecting the terminal block 30 to the connector 71 in the second embodiment is now described.

First, the connector 71 is placed near the terminal block 30 fixed to the case 11 with the spring member 80 positioned between the contact surface 55A of the wire connection portion 55 and the connector 71 so that the spring member 80 is in contact with the contact surface 75A of the connection portion 75. From this contact state, as the connector 71 is moved closer to the terminal block 30 to bring the contact surfaces 55A and 75A further closer to each other, the pressing force is applied to the spring member 80 from the connection portion 75. The spring member 80 thus receives a load (compressive load) in the height direction Z perpendicular to the coil axis of the spring member 80. Then, as shown in FIG. 6, the spring member 80 is elastically deformed against its elastic force, so that the winding surfaces collapse toward the coil axis. The spring member 80 is thus compressed in the height direction Z between the contact surfaces 55A and 75A. As a result, the wire connection portion 55 and the wire terminal 72 are electrically connected via the spring member 80.

Figure 7:
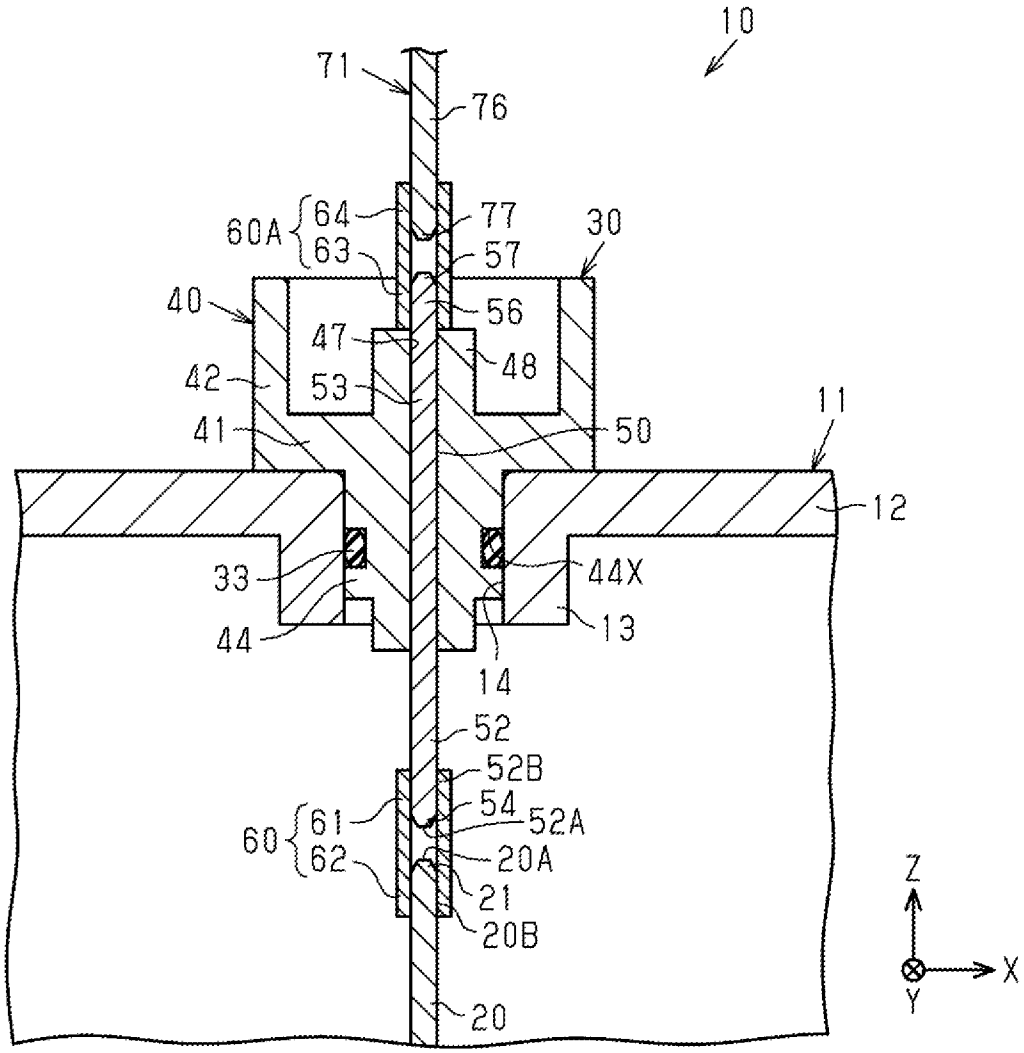
FIG. 7 is a schematic cross-sectional view showing a connection device of a third embodiment.

As shown in FIG. 7, in a third embodiment, in the same manner as the connection between the device connection portion 52 and the device terminal 20, the wire connection portion 56 may be electrically connected to the wire terminal 76 via a tubular metal joint portion 60A. The configuration of a terminal block 30 of the third embodiment is now described. The description focuses on the differences from the embodiment described above. Same reference numerals are given to those components that are the same in the embodiments described above. Descriptions of some or all of such components may be omitted.

A housing 40 has a terminal holding portion 48 provided in a hood portion 42. The terminal holding portion 48 may be formed inside the hood portion 42 so as to project upward from the upper surface of the main body portion 41. The terminal holding portion 48 has a holding hole 47 extending through the terminal holding portion 48 in the height direction Z. The holding hole 47 may extend the terminal holding portion 48, the main body portion 41, and the insertion portion 44 in the height direction Z. The holding hole 47A holds a connection terminal 50.

The connection terminal 50 may be formed in an I-shape (linear). The wire connection portion 56 may be connected to the upper end of the middle portion 53. The wire connection portion 56 may extend linearly in the height direction Z. The wire connection portion 56 may extend parallel to the longitudinal direction of the middle portion 53. The wire connection portion 56 may project upward from the upper surface of the terminal holding portion 48. In the following description, for convenience, the portion of the connection terminal 50 that projects upward from the upper surface of the terminal holding portion 48 is referred to as a wire connection portion 56.

The wire connection portion 56 may be inserted in a tubular joint portion 60A. The wire connection portion 56 may be press-fitted into the joint portion 60A.

The joint portion 60A may have the same structure as the joint portion 60. The joint portion 60A of the third embodiment has the shape of a polygonal tube. The joint portion 60A may include a tubular section 63, in which the distal end portion of the wire connection portion 56 is inserted, and a tubular section 64, in which the distal end portion of the wire terminal 76 is inserted. The joint portion 60A may be a single component in which the tubular sections 63 and 64 are integrally formed. In the joint portion 60A, the internal space of the tubular section 63 may connect to the internal space of the tubular section 64.

The wire connection portion 56 may have the shape of a flat plate. The outer perimeter shape of the wire connection portion 56 may be mathematically similar to the inner perimeter shape of the tubular section 63 of the joint portion 60A. In the third embodiment, the wire connection portion 56 is formed in the shape of a quadrangular column having a rectangular outer perimeter, while the tubular section 63 is formed in the shape of a quadrangular tube having rectangular inner and outer perimeters. The inner perimeter dimension of the tubular section 63 may be smaller than the outer perimeter dimension of the wire connection portion 56. The distal end portion (the upper end portion in this example) of the wire connection portion 56 may include a tapered guide section 57. The guide section 57 may have the same configuration as the guide section 54 of the device connection portion 52. A detailed description of the guide section 57 is therefore omitted.

The wire connection portion 56 is press-fitted into the tubular section 63 by a predetermined length so that a predetermined area of the outer surface of the wire connection portion 56 is in close contact with the inner surface of the tubular section 63. The wire connection portion 56 of the third embodiment is press-fitted into the tubular section 63 over its entire length in the longitudinal direction. The close contact between the outer surfaces of the wire connection portion 56 and the inner surfaces of the tubular section 63 electrically connects the wire connection portion 56 to the tubular section 63. Furthermore, the end surface of the tubular section 63 in the longitudinal direction may be in contact with the upper surface of the terminal holding portion 48.

The connector 71 has a wire terminal 76. The wire terminal 76 may be held in a connector housing (not shown). The wire terminal 76 may extend linearly in the height direction Z. The wire terminal 76 may extend parallel to the longitudinal direction of the wire connection portion 56. In one example, the wire terminal 76 has the shape of a flat plate. In one example, the wire terminal 76 has the shape of a polygonal column.

The distal end portion (the lower end portion in this example) of the wire terminals 76 may be inserted in the tubular section 64 of the joint portion 60A. The distal end portion of the wire terminal 76 may be press-fitted into the tubular section 64. The inner perimeter shape of the tubular section 64 may be mathematically similar to the outer perimeter shape of the wire terminal 76. In the third embodiment, the tubular section 64 is formed in the shape of a quadrangular tube having rectangular inner and outer perimeters, while the wire terminal 76 is formed in the shape of a quadrangular column having a rectangular outer perimeter. The inner perimeter dimension of the tubular section 64 may be smaller than the outer perimeter dimension of the wire terminal 76. The distal end portion of the wire terminal 76 may include a tapered guide section 77. The guide section 77 may have the same configuration as the guide section 54 of the device connection portion 52. A detailed description of the guide section 77 is therefore omitted.

The distal end portion of the wire terminal 76 is press-fitted into the tubular section 64 by a predetermined length so that a predetermined area of the outer surfaces of the wire terminal 76 is in close contact with the inner surfaces of the tubular section 64. The close contact between the outer surfaces of the wire terminal 76 and the inner surfaces of the tubular section 64 electrically connects the wire terminal 76 to the tubular section 64. The wire terminal 76 is thus electrically connected to the wire connection portion 56 through the joint portion 60A.

In the third embodiment shown in FIG. 7, the electrical connection between the device connection portion 52 and the device terminal 20 may be changed to a connection by means of bolting or a spring member.

In the above embodiment, the joint portions 60 are individually coupled to all of the connection terminals 50 of the terminal block 30. The configuration is not limited to this, and joint portions 60 may be coupled to only some of the connection terminals 50, for example. In this case, only the device connection portions 52 of some of the connection terminals 50 are electrically connected to device terminals 20 via joint portions 60. The device connection portions 52 of the remaining connection terminals 50 may be electrically connected to device terminals 20 by bolting.

In each joint portion 60 of the embodiment described above, the internal space of the tubular section 61 connects to the internal space of the tubular section 62, but the configuration is not limited to this.

Figure 8:
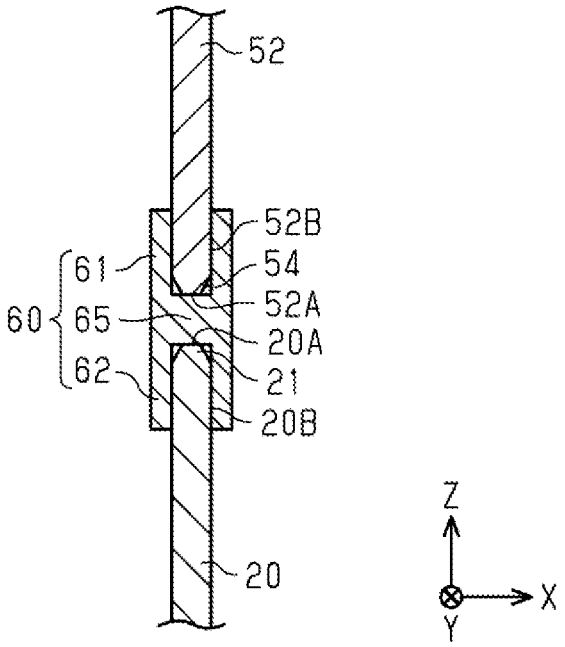
FIG. 8 is a schematic cross-sectional view showing a part of a connection device of a fourth embodiment.

For example, in a fourth embodiment, as shown in FIG. 8, a partition wall 65 for separating the internal space of the tubular section 61 from the internal space of the tubular section 62 may be provided between the tubular sections 61 and 62. In this case, the distal end surface 52A of the device connection portion 52 may be in contact with the partition wall 65, and the distal end surface 20A of the device terminal 20 may be in contact with the partition wall 65. This configuration can control the amount of insertion of the device connection portion 52 relative to the tubular section 61 and also control the amount of insertion of the device terminal 20 relative to the tubular section 62.

In the above embodiment, the inner perimeter shape of the tubular section 61 is smaller than the outer perimeter shape of the device connection portion 52, but the configuration is not limited to this. For example, the inner perimeter shape of the tubular section 61 may be the same as the outer perimeter shape of the device connection portion 52.

In the above embodiment, the inner perimeter shape of the tubular section 62 is smaller than the outer perimeter shape of the device terminal 20, but the configuration is not limited to this. For example, the inner perimeter shape of the tubular section 62 may be the same as the outer perimeter shape of the device terminal 20.

In the above embodiment, the end portion of the device connection portion 52 is press-fitted into the tubular section 61, and the end portion of the device terminal 20 is press-fitted into the tubular section 62, but the configuration is not limited to this.

Figure 9:
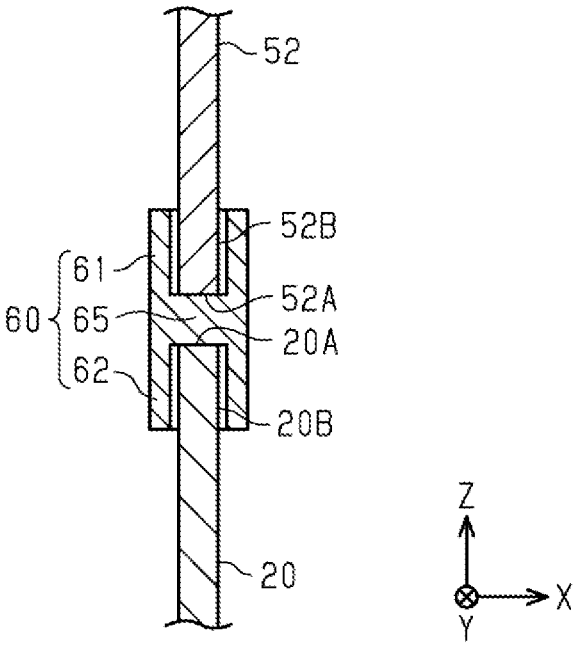
FIG. 9 is a schematic cross-sectional view showing a part of a connection device of a fifth embodiment.

For example, in a fifth embodiment, as shown in FIG. 9, the end portion of the device connection portion 52 may be inserted into the tubular section 61 without being press-fitted into the tubular section 61. For example, the outer perimeter shape of the device connection portion 52 may be smaller than the inner perimeter shape of the tubular section 61. In this case, the distal end surface 52A of the device connection portion 52 may be brought into contact with the partition wall 65 of the joint portion 60, thereby electrically connecting the device connection portion 52 to the joint portion 60. That is, the electrical connection between the device connection portion 52 and the joint portion 60 is achieved by the distal end surface 52A of the device connection portion 52 abutting the partition wall 65. In this case, to increase the area of contact between the distal end surface 52A of the device connection portion 52 and the partition wall 65, the guide section 54 shown in FIG. 1 is preferably omitted.

Also, the end portion of the device terminal 20 may be inserted into the tubular section 62 without being press-fitted. For example, the outer perimeter shape of the device terminal 20 may be smaller than the inner perimeter shape of the tubular section 62. In this case, the distal end surface 20A of the device terminal 20 may be brought into contact with the partition wall 65 of the joint portion 60, thereby electrically connecting the device terminal 20 to the joint portion 60. That is, the electrical connection between the device terminal 20 and the joint portion 60 is achieved by the distal end surface 20A of the device terminal 20 abutting the partition wall 65. In this case, to increase the area of contact between the distal end surface 20A of the device terminal 20 and the partition wall 65, the guide section 21 shown in FIG. 1 is preferably omitted.

Figure 10:
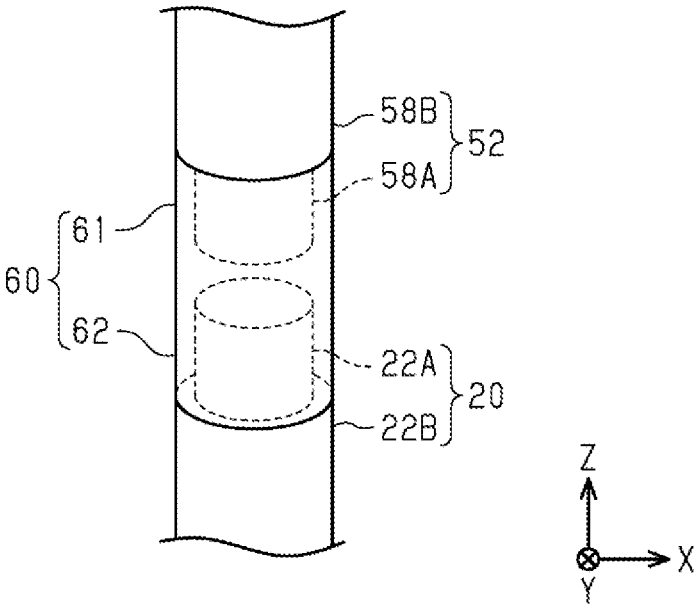
FIG. 10 is a schematic perspective view showing a part of a connection device of a sixth embodiment.

For example, in a sixth embodiment, as shown in FIG. 10, the device connection portion 52 may have the shape of a circular column, and the tubular section 61 of the joint portion 60 may have the shape of a circular tube. The device terminal 20 may have the shape of a circular column, and the tubular section 62 of the joint portion 60 may have the shape of a circular tube.

The device connection portion 52 of the sixth embodiment has an insertion section 58A, which is inserted in the tubular section 61, and a non-insertion section 58B, which has a greater outer perimeter dimension than the insertion section 58A and is not inserted in the tubular section 61. The outer perimeter shape of the insertion section 58A may be mathematically similar to the inner perimeter shape of the tubular section 61. For example, the insertion section 58A has the shape of a circular column, and the tubular section 61 has the shape of a circular tube. The insertion section 58A may be press-fitted into the tubular section 61. The outer perimeter dimension of the insertion section 58A may be greater than the inner perimeter dimension of the tubular section 61.

Figure 11:
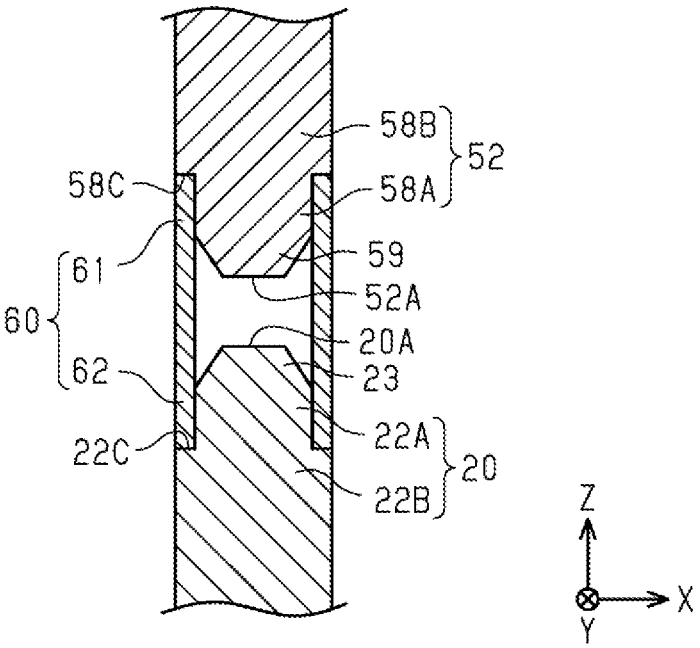
FIG. 11 is a schematic cross-sectional view showing a part of a connection device of a seventh embodiment.

As shown in FIG. 11, in a seventh embodiment, the distal end portion of the insertion section 58A may include a tapered guide section 59. The guide section 59 may be tapered toward the distal end surface 52A of the device connection portion 52. The guide section 59 may extend from a position in the longitudinal direction of the device connection portion 52 to the distal end surface 52A. The outer perimeter dimension of the guide section 59 is smaller than the outer perimeter dimension of the section of the insertion section 58A other than the guide section 59. The most part of the guide section 59 may have an outer perimeter dimension that is smaller than the inner perimeter dimension of the tubular section 61. The outer surface of the guide section 59 is an inclined surface that is inclined from a middle section in the longitudinal direction of the insertion section 58A so as to be closer to the central axis of the device connection portion 52 toward the distal end surface 52A. When the insertion section 58A is press-fitted into the tubular section 61, the guide section 59 functions to guide the section of the insertion section 58A other than the guide section 59 into the tubular section 61.

The outer perimeter shape of the non-insertion section 58B may be mathematically similar to the outer perimeter shape of the insertion section 58A. The outer perimeter shape of the non-insertion section 58B may be mathematically similar to the inner perimeter shape of the tubular section 61. The non-insertion section 58B may have the shape of a circular column. The outer perimeter dimension of the non-insertion section 58B may be equivalent to the outer perimeter dimension of the tubular section 61.

In the device connection portion 52, the outer surface of the insertion section 58A, an end surface of the non-insertion section 58B located at the insertion section 58A, and the outer surface of the non-insertion section 58B may form a step section 58C.

The insertion section 58A of the device connection portion 52 may be press-fitted into the tubular section 61 over its entire length in the longitudinal direction. The close contact between the outer surface of the insertion section 58A and the inner surface of the tubular section 61 electrically connects the device connection portion 52 to the tubular section 61. Furthermore, the end surface of the tubular section 61 in the longitudinal direction is in contact with the end surface of the non-insertion section 58B at the insertion section 58A. This controls the amount of insertion of the device connection portion 52 relative to the tubular section 61.

As shown in FIG. 10, the device terminal 20 of the seventh embodiment has an insertion section 22A, which is inserted in the tubular section 62, and a non-insertion section 22B, which has a greater outer perimeter dimension than the insertion section 22A and is not inserted in the tubular section 62. The outer perimeter shape of the insertion section 22A may be mathematically similar to the inner perimeter shape of the tubular section 62. For example, the insertion section 22A has the shape of a circular column, and the tubular section 62 has the shape of a circular tube. The insertion section 22A may be press-fitted into the tubular section 62. The outer perimeter dimension of the insertion section 22A may be greater than the inner perimeter dimension of the tubular section 62.

As shown in FIG. 11, the distal end portion of the insertion section 22A may include a tapered guide section 23. The guide section 23 may be tapered toward the distal end surface 20A of the device terminal 20. The guide section 23 may extend from a position in the longitudinal direction of the device terminal 20 to the distal end surface 20A. The outer perimeter dimension of the guide section 23 is smaller than the outer perimeter dimension of the section of the insertion section 22A other than the guide section 23. The most part of the guide section 23 may have an outer perimeter dimension that is smaller than the inner perimeter dimension of the tubular section 62. The outer surface of the guide section 23 is an inclined surface that is inclined from a middle section in the longitudinal direction of the insertion section 22A so as to be closer to the central axis of the device terminal 20 toward the distal end surface 20A. When the insertion section 22A is press-fitted into the tubular section 62, the guide section 23 functions to guide the section of the insertion section 22A other than the guide section 23 into the tubular section 62.

The outer perimeter shape of the non-insertion section 22B may be mathematically similar to the outer perimeter shape of the insertion section 22A. The outer perimeter shape of the non-insertion section 22B may be mathematically similar to the inner perimeter shape of the tubular section 62. The non-insertion section 22B may have the shape of a circular column. The outer perimeter dimension of the non-insertion section 22B may be equivalent to the outer perimeter dimension of the tubular section 62.

In the device terminal 20, the outer surface of the insertion section 22A, the end surface of the non-insertion section 22B located at the insertion section 22A, and the outer surface of the non-insertion section 22B may form a step section 22C.

The insertion section 22A of the device terminal 20 may be press-fitted into the tubular section 62 over its entire length in the longitudinal direction. The close contact between the outer surface of the insertion section 22A and the inner surface of the tubular section 62 electrically connects the device terminal 20 to the tubular section 62. Furthermore, the end surface of the tubular section 62 in the longitudinal direction is in contact with the end surface of the non-insertion section 22B at the insertion section 22A. This controls the amount of insertion of the device terminal 20 relative to the tubular section 62.

In the sixth embodiment and the seventh embodiment shown in FIGS. 10 and 11, the outer perimeter shape of the non-insertion section 58B does not have to be mathematically similar to the outer perimeter shape of the insertion section 58A or the inner perimeter shape of the tubular section 61. For example, the non-insertion section 58B may have the shape of a polygonal column, and the insertion section 58A may have the shape of a circular column.

In the sixth embodiment and the seventh embodiment shown in FIGS. 10 and 11, the outer perimeter shape of the non-insertion section 22B does not have to be mathematically similar to the outer perimeter shape of the insertion section 22A or the inner perimeter shape of the tubular section 62. For example, the non-insertion section 22B may have the shape of a polygonal column, and the insertion section 22A may have the shape of a circular column.

The device connection portion 52 shown in FIG. 1 may have a step section that is similar to the step section 58C shown in FIG. 11.

The device terminal 20 shown in FIG. 1 may have a step section that is similar to the step section 22C shown in FIG. 11.

In the above embodiment, the outer perimeter shape of the device connection portion 52 is mathematically similar to the inner perimeter shape of the tubular section 61, but the configuration is not limited to this. For example, the device connection portion 52 may have the shape of a circular column, and the tubular section 61 may have the shape of a polygonal tube.

In the above embodiment, the outer perimeter shape of the device terminal 20 is mathematically similar to the inner perimeter shape of the tubular section 62, but the configuration is not limited to this. For example, the device terminal 20 may have the shape of a circular column, and the tubular section 62 may have the shape of a polygonal tube.

In the joint portion 60 of the above embodiment, the tubular sections 61 and 62 are identical in shape. That is, the tubular sections 61 and 62 each have the shape of a quadrangular tube having rectangular inner and outer perimeters. However, the configuration of the joint portion 60 is not limited to this. For example, the tubular sections 61 and 62 may have different shapes. For example, the tubular section 61 may have the shape of a circular tube, and the tubular section 62 may have the shape of a polygonal tube. In this case, it is preferable that the device connection portion 52 be in the shape of a circular column and the device terminal 20 be in the shape of a polygonal column. Alternatively, the tubular section 61 may be in the shape of a polygonal tube, and the tubular section 62 may be in the shape of a circular tube. In this case, it is preferable that the device connection portion 52 be in the shape of a polygonal column and the device terminal 20 be in the shape of a circular column.

The inclined surfaces 54B may be omitted from the guide section 54 of the above embodiments. In this case, the guide section 54 may consist only of the inclined surfaces 54A.

The guide section 54 may be omitted from the device connection portion 52 of the above embodiments.

The inclined surfaces 21B may be omitted from the guide section 21 of the above embodiments. In this case, the guide section 21 may consist only of the inclined surfaces 21A.

The guide section 21 may be omitted from the device terminal 20 of the above embodiments.

With the terminal block 30 of the above embodiment, the number of connection terminals 50 held in the housing 40 is three, but there is no limitation to the number, and the number of connection terminals 50 may be modified according to the specifications of the vehicle or the like. The number of connection terminals 50 held in the housing 40 may be two or four or more.

The present disclosure includes the following implementation examples. Some of the components of illustrative embodiments are specified by reference numerals that are intended to be used as an aid in understanding and are not intended to be limiting. Some of the items described in the following implementation examples may be omitted, or some of the items described in the implementation examples may be selected or extracted and combined.

[Note 1] In some implementation examples of the present disclosure, the inner surface of the joint portion (60) is in direct contact with the outer surface (52B) of the end portion (52) of the connection terminal (50) with friction resistance occurring in between. The joint portion (60) and the end portion (52) of the connection terminal (50) are retained to each other only by the friction resistance.

[Note 2] In some implementation examples of the present disclosure, the joint portion (60) has a radial inner surface that is free of a thread.

[Note 3] In some implementation examples of the present disclosure, the end portion (52) of the connection terminal (50) has a radial outer surface that is free of a thread.

[Note 4] In some implementation examples of the present disclosure, the joint portion (60) and the end portion (52) of the connection terminal (50) are retained to each other only by the friction resistance between the radial inner surface of the joint portion (60) that is free of a thread and the radial outer surface of the end portion (52) of the connection terminal (50) that is free of a thread.

[Note 5] In some implementation examples of the present disclosure, the joint portion (60) has a tubular wall having a uniform thickness, and the tubular wall is a solid wall that has a smooth radial inner surface and is free of a hole.

[Note 6] In some implementation examples of the present disclosure, the end portion (52) of the connection terminal (50) is a solid metal body that has a smooth radial outer surface and is free of a hole.

[Note 7] In some implementation examples of the present disclosure, the joint portion (60) is a linear metal tube.

[Note 8] In some implementation examples of the present disclosure, the joint portion (60) has a uniform inner diameter.

[Note 9] In some implementation examples of the present disclosure, the joint portion (60) has a uniform thickness.

[Note 10] In some implementation examples of the present disclosure, the end portion (52) of the connection terminal (50) is linear.

It should be understood that the embodiments disclosed herein are only illustrative in all respects and should not be taken as limiting. It is intended that the scope of the present invention is defined in the claims, not by the descriptions above, and covers all modifications within the scope of the claims and their equivalent.

REFERENCE SIGNS LIST

10 . . . Connection Device
11 . . . Case
12 . . . Case Main Body
13 . . . Mount Portion
14 . . . Mount Hole
20 . . . Device Terminal (Counterpart Terminal)
20A . . . Distal End Surface
20B . . . Outer Surface
21 . . . Guide Section
21A . . . Inclined Surface
21B . . . Inclined Surface
22A . . . Insertion Section
22B . . . Non-Insertion Section
22C . . . Step Section
23 . . . Guide Section
30 . . . Terminal Block
31 . . . Collar
32 . . . Nut
32X . . . Through Hole
33 . . . Rubber Ring
40 . . . Housing
41 . . . Main Body Portion
42 . . . Hood Portion
43 . . . Nut Housing Portion
43X . . . Recess
44 . . . Insertion Portion
44A . . . Base Portion
44B . . . Terminal Holding Portion
44X . . . Housing Groove
45 . . . Fixing Section

46 . . . Through Hole
47 . . . Holding Hole
48 . . . Terminal Holding Portion
50 . . . Connection Terminal
51 . . . Wire Connection Portion (Second End Portion)
51X . . . Bolt Insertion Hole
52 . . . Device Connection Portion (First End Portion)
52A . . . Distal End Surface
52B . . . Outer Surface
53 . . . Middle Portion
54 . . . Guide Section
54A . . . Inclined Surface (First Inclined Surface)
54B . . . Inclined Surface (Second Inclined Surface)
55 . . . Wire Connection Portion
55A . . . Contact Surface
56 . . . Wire Connection Portion
57 . . . Guide Section
58A . . . Insertion Section
58B . . . Non-Insertion Section
58C . . . Step Section
59 . . . Guide Section
60 . . . Joint Portion (First Joint Portion)
60A . . . Joint Portion (Second Joint Portion)
61 . . . Tubular Section (First Tubular Section)
62 . . . Tubular Section (Second Tubular Section)
63 . . . Tubular Section
64 . . . Tubular Section
65 . . . Partition Wall
70 . . . Wire Harness
71 . . . Connector
72 . . . Wire Terminal
73 . . . Connector Housing
74 . . . Connection Portion
74X . . . Bolt Insertion Hole
75 . . . Connection Portion
75A . . . Contact Surface
76 . . . Wire Terminal (Counterpart Terminal)
77 . . . Guide Section
80 . . . Spring Member

The invention claimed is:

1. A terminal block, comprising:
a housing made of a synthetic resin;
a metal connection terminal that is columnar and held by the housing; and
a metal joint portion that is tubular and in which an end portion of the connection terminal is inserted,
wherein the joint portion includes a cylindrical inner surface that extends unbrokenly and continuously over entire length of the joint portion and over entire circumference of the joint portion.

2. The terminal block according to claim 1, wherein
the joint portion includes a first tubular section in which the end portion of the connection terminal is inserted and a second tubular section in which an end portion of a counterpart terminal to be electrically connected to the connection terminal is to be inserted,
the first tubular section extends over a first cylinder length, the first tubular section includes a first cylindrical inner surface that extends unbrokenly and continuously over the first cylinder length of the first tubular section and over entire circumference of the first tubular section,
the second tubular section extends over a second cylinder length, the second tubular section includes a second cylindrical inner surface that extends unbrokenly and continuously over the second cylinder length of the second tubular section and over entire circumference of the second tubular section,
the first cylindrical inner surface of the first tubular section is in direct contact with an outer surface of the end portion of the connection terminal, and
the second cylindrical inner surface of the second tubular section is in direct contact with an outer surface of the end portion of the counterpart terminal.

3. A terminal block, comprising:
a housing made of a synthetic resin;
a metal connection terminal that is columnar and held by the housing; and
a metal joint portion that is tubular and in which an end portion of the connection terminal is inserted, wherein
the joint portion has a tubular wall continuous over entire circumferential circumference of the joint portion, the tubular wall is a solid wall that has a smooth radial inner surface and is free of a hole, and
an inner surface of the joint portion is in direct contact with an outer surface of the end portion of the connection terminal and thus the joint portion and the end portion of the connection terminal are retained to each other.

4. The terminal block according to claim 3, wherein
the end portion of the connection terminal includes an insertion section inserted in the joint portion and a non-insertion section that has a greater outer perimeter dimension than the insertion section and is not inserted in the joint portion,
an outer surface of the non-insertion section, an end surface of the non-insertion section located at the insertion section, and an outer surface of the insertion section form a step section, and
the end surface of the non-insertion section located at the insertion section is in contact with an end surface of the joint portion.

5. The terminal block according to claim 3, wherein
when the joint portion is a first joint portion and the end portion of the connection terminal that is inserted in the first joint portion is a first end portion,
the connection terminal has a second end portion that is opposite to the first end portion in the longitudinal direction of the connection terminal, and
the terminal block further comprises a metal second joint portion that is tubular and in which the second end portion of the connection terminal is inserted.

6. The terminal block according to claim 1, wherein
the end portion of the connection terminal has a guide section that is tapered toward a distal end surface that is located at a leading end in an insertion direction of the connection terminal relative to the joint portion, and
the guide section extends from a middle section in a longitudinal direction of the connection terminal to the distal end surface.

7. The terminal block according to claim 6, wherein
the connection terminal has a shape of a quadrangular column,
the connection terminal has the distal end surface and four outer surfaces that are located around the distal end surface and connected to the distal end surface, and
the guide section includes a first inclined surface that is located in each of the outer surfaces and continuously inclined toward the distal end surface.

8. The terminal block according to claim 7, wherein the guide section includes a second inclined surface that is located between adjacent ones of the first inclined surfaces and continuously inclined toward the distal end surface.

9. The terminal block according to claim 3, wherein the joint portion includes a first tubular section in which the end portion of the connection terminal is inserted and a second tubular section in which an end portion of a counterpart terminal to be electrically connected to the connection terminal is to be inserted, and the connection terminal is configured to be electrically connected to the counterpart terminal via the joint portion.

10. The terminal block according to claim 9, wherein the first tubular section has an inner perimeter shape that is mathematically similar to an outer perimeter shape of the end portion of the connection terminal, and the second tubular section has an inner perimeter shape that is mathematically similar to an outer perimeter shape of the end portion of the counterpart terminal.

11. The terminal block according to claim 10, wherein the connection terminal has a shape of a polygonal column or a circular column, the counterpart terminal has a shape of a polygonal column or a circular column, the first tubular section has a shape of a polygonal tube or a circular tube, and the second tubular section has a shape of a polygonal tube or a circular tube.

12. The terminal block according to claim 10, wherein the first tubular section has an inner perimeter dimension that is smaller than an outer perimeter dimension of the end portion of the connection terminal.

13. The terminal block according to claim 10, wherein the second tubular section has an inner perimeter dimension that is smaller than an outer perimeter dimension of the end portion of the counterpart terminal.

* * * * *